US007874544B2

(12) United States Patent
Monroe

(10) Patent No.: US 7,874,544 B2
(45) Date of Patent: Jan. 25, 2011

(54) LIFTING DEVICE

(76) Inventor: Dana Monroe, 5408 SE. Hawthorne Blvd., Portland, OR (US) 97215-3366

( * ) Notice: Subject to any disclaimer, the term of this patent is extended or adjusted under 35 U.S.C. 154(b) by 413 days.

(21) Appl. No.: 12/043,032

(22) Filed: Mar. 5, 2008

(65) Prior Publication Data

US 2009/0224221 A1 Sep. 10, 2009

(51) Int. Cl.
*B66D 1/26* (2006.01)

(52) U.S. Cl. ..... 254/285; 254/279; 254/281; 254/286; 254/324; 254/326

(58) Field of Classification Search ..... 254/278, 254/279, 280, 281, 283, 284, 285, 286, 324, 254/325, 326, 393
See application file for complete search history.

(56) References Cited

U.S. PATENT DOCUMENTS

| | | | | | |
|---|---|---|---|---|---|
| 209,519 | A | | 10/1878 | Sands | |
| 606,858 | A | | 7/1898 | Edwards | |
| 616,972 | A | | 1/1899 | Raynor | |
| 776,797 | A | | 12/1904 | Plant | |
| 1,101,217 | A | | 6/1914 | Stamm | |
| 1,273,143 | A | | 7/1918 | Bryan | |
| 1,984,604 | A | * | 12/1934 | Stahl | 254/278 |
| 2,019,511 | A | * | 11/1935 | Stahl | 254/278 |
| 2,276,127 | A | | 3/1942 | Wahl | |
| 2,473,173 | A | | 6/1949 | Petersen | |
| 2,632,530 | A | * | 3/1953 | Wagner | 187/226 |
| 2,706,057 | A | | 4/1955 | Belding | |
| 2,763,339 | A | * | 9/1956 | North | 52/121 |
| 3,000,473 | A | | 9/1961 | Reynolds | |
| 3,366,407 | A | | 1/1968 | Cernosek | |
| 3,414,087 | A | | 12/1968 | Schmiesing | |
| 3,672,634 | A | | 6/1972 | Chaffin | |
| 3,757,899 | A | * | 9/1973 | Smith, Jr. | 187/224 |
| 3,802,136 | A | * | 4/1974 | Eiler et al. | 52/115 |
| 4,015,686 | A | * | 4/1977 | Bushnell, Jr. | 182/148 |
| 4,101,109 | A | | 7/1978 | Edwards | |
| 4,436,183 | A | * | 3/1984 | Laurich-Trost | 187/224 |
| 4,590,720 | A | | 5/1986 | Reed | |
| 4,619,346 | A | * | 10/1986 | Deguerry | 187/243 |

(Continued)

OTHER PUBLICATIONS

Genie Parts List, DPL Super Series, Part No. 40461, Rev C4, Nov. 2007, pp. 1-95.

(Continued)

*Primary Examiner*—Emmanuel M Marcelo
(74) *Attorney, Agent, or Firm*—Joseph P. Curtin, L.L.C.

(57) ABSTRACT

A lifting device comprises at least two multi-stage masts and a cable mechanism. Each multi-stage mast comprises a first length and a second length that is longer than the first length. Each multi-stage mast further comprises a plurality of stages, such that at least one stage of a mast is vertically movable with respect to at least one other stage. The cable mechanism comprises a spool and at least one cable that is coupled to the spool and arranged with respect to the multi-stage masts so that when each cable is wound onto the spool, each mast simultaneously and in unison changes length in a direction from the first length to the second length, and when each cable is unwound off the spool, each mast changes length simultaneously and in unison in a direction from the second length to the first length.

31 Claims, 20 Drawing Sheets

U.S. PATENT DOCUMENTS

| | | | |
|---|---|---|---|
| 4,767,099 | A | 8/1988 | Munks |
| 4,861,192 | A | 8/1989 | Porter |
| 4,861,218 | A | 8/1989 | Lamer |
| 4,928,927 | A | 5/1990 | Fredrick et al. |
| 4,941,645 | A | 7/1990 | Hall |
| 4,962,913 | A | 10/1990 | Stewart |
| 5,298,693 | A | 3/1994 | Heijn |
| 5,515,945 | A | 5/1996 | Smith et al. |
| 5,772,183 | A | 6/1998 | Sears |
| 5,813,659 | A | 9/1998 | Heidle |
| 6,234,453 | B1 | 5/2001 | Block |
| 6,494,150 | B1 | 12/2002 | Phoenix et al. |
| 6,536,554 | B2 | 3/2003 | Andrews et al. |
| 6,640,924 | B2 | 11/2003 | Messner |
| 7,188,843 | B2 | 3/2007 | Magness |
| 2002/0153195 | A1 | 10/2002 | Messner |
| 2007/0108791 | A1 | 5/2007 | Okninski |

OTHER PUBLICATIONS

Genie Aerial Work Platforms, 2007, pp. 1-20.

* cited by examiner

LIFTING DEVICE

BACKGROUND

The subject matter disclosed herein relates to a lifting device. In particular, the subject matter disclosed herein relates to a lifting device comprising a plurality of multi-stage masts.

BRIEF DESCRIPTION OF THE DRAWINGS

The subject matter disclosed herein is illustrated by way of example and not by limitation in the accompanying figures in which like reference numerals indicate similar elements and in which.

DETAILED DESCRIPTION

Figure 1A:
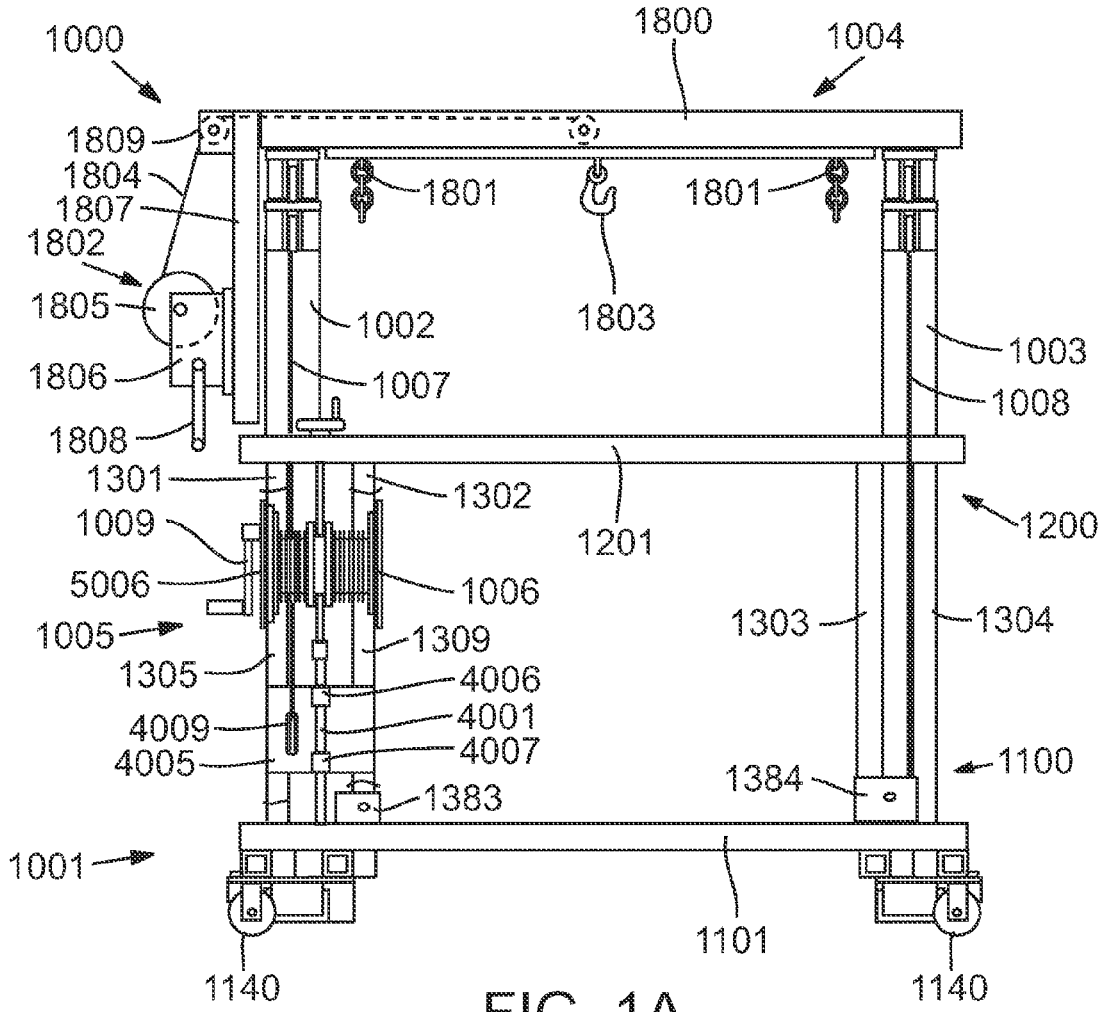
FIGS. 1A-1D respectively depict front, left, right and top views of an exemplary embodiment of a lifting device comprising two multi-stage masts in a non-telescoped position according to the subject matter disclosed herein.

The word "exemplary" is used herein to mean "serving as an example, instance, or illustration." Accordingly, any embodiment described herein as "exemplary" should not be construed as necessarily preferred or advantageous over other embodiments.

The subject matter disclosed herein relates to a lifting device. One exemplary embodiment of a lifting device according to the subject matter disclosed herein is suitable for moving and lifting speakers for theatrical productions and/or entertainment events to a selected height. Another exemplary embodiment of a lifting device according to the subject matter disclosed herein is suitable for moving and lifting stage lighting equipment for theatrical productions and/or entertainment events to a selected height. Yet another exemplary embodiment of a lifting device according to the subject matter disclosed herein is designed to fit under the roll-up door of a typical cube-type delivery van so that speakers and/or lighting equipment can be conveniently loaded onto the lifting device at one location and transported to another location. Still another exemplary embodiment of a lifting device according to the subject matter disclosed herein is designed to fit under the roll-up door of a larger truck so that speakers and/or lighting equipment can be conveniently loaded onto the lifting device at one location and transported to another location.

Additionally, one exemplary embodiment of a lift device according to the subject matter disclosed herein is configured to occupy a minimal amount of space when loaded onto a truck, such as a delivery van or larger type truck. For example, one exemplary embodiment of a lifting device according to the subject matter disclosed herein is configured to be less than about 30" in width so that up to three lifting devices can be placed in the interior truck box of a standard trailer having a width of about 90". The approximate 30" width of this exemplary embodiment permits the lift device to be placed far enough to the right or left of the interior space of a standard cube-type van or trailer truck box and thereby not inhibit further loading of the center of the space. Further still, a load, such as a dolly-mounted preconfigured speaker line array and/or lighting equipment, can be placed within a load holding area of the lifting device so that the lifting device provides protection for the load during packing, transporting and/or for generally storing of the load.

FIGS. 1A-1D respectively depict front, left, right and top views of an exemplary embodiment of a lifting device 1000 comprising two multi-stage masts in a non-telescoped position according to the subject matter disclosed herein. FIGS. 2A-2C respectively depict front, left and right views of the exemplary embodiment of lifting device 1000 of FIGS. 1A-1D in which the multi-stage masts are in a telescoped position supporting a lifted object according to the subject matter disclosed herein. FIG. 2D depicts a perspective view of the exemplary embodiment of lifting device 1000 in which the multi-stage masts are in a telescoped configuration according to the subject matter disclosed herein. FIG. 2E depicts a cutaway perspective view from below of an exemplary embodiment of a multi-stage mast and a fly bar according to the subject matter disclosed herein. It should be noted that for clarity not all components of lifting device 1000 are indicated and/or shown in each of the accompanying Figures.

Lifting device 1000 comprises a frame 1001, two multi-stage masts 1002 and 1003 that are attached to frame 1001, and a support member 1004 (also referred to herein as a fly bar 1004) that spans between the tops of masts 1002 and 1003. A cable mechanism 1005 is used for raising and lowering the stages of masts 1002 and 1003 between a non-telescoped position (FIGS. 1A-1D) and a telescoped position (FIGS. 2A-2D). Cable mechanism 1005 comprises a dual cable spool 1006, cables 1007 and 1008, and a crank arm 1009. Cables 1007 and 1008 respectively have paths through sheaves and/or idler wheels that are external and/or internal to multi-stage masts 1002 and 1003. In one exemplary embodiment, cables 1007 and 1008 are respectively wound onto dual cable spool 1006 using a removable crank arm 1009 (not shown in FIGS. 1B and 1C) to raise multi-stage masts 1002 and 1003 simultaneously and substantially in unison from the non-telescoped position to the telescoped position. Conversely, cables 1007 and 1008 are respectively unwound from dual spool 1006 using removable crank arm 1009 (not shown in FIGS. 1B and 1C) in a well-known manner to lower masts 1002 and 1003 simultaneously and substantially in unison from the telescoped position to the non-telescoped position. In one exemplary embodiment, the respective effective lengths of cables 1007 and 1008 can be adjusted so that as cables 1007 and 1008 are wound onto and unwound from dual spool 1006, multi-stage masts 1002 and 1003 are raised and lowered between the non-telescoped position and the telescoped position simultaneously and substantially in unison so that fly bar 1004 remains substantially horizontal. In another exemplary embodiment, the respective effective lengths of cables 1007 and 1008 can be adjusted so that as cables 1007 and 1008 are wound onto and unwound from dual spool 1006, multi-stage masts 1002 and 1003 are raised and lowered between the non-telescoped position and the telescoped position simultaneously and substantially in unison so that fly bar 1004 remains substantially at a selected orientation with respect to the horizontal. While crank arm 1009 has been indicated to be removable, it should be understood that in an alternative exemplary embodiment, crank arm 1009 could be non-removable.

Frame 1001 comprises abase frame 1100 and atop frame 1200. Base frame 1100 comprises base frame members 1101, 1102, 1103, 1104 and 1105, which are fastened together in a well-known manner to form base frame 1100, such as by welding and/or by using fastening devices such as, but not limited to, nuts and bolts, so that base frame 1100 comprises a U shape when viewed from above (FIG. 1D). In one exemplary embodiment, wheels 1140 are attached to the bottom of base frame 1100 in a well-known manner using castors for two or more of the wheels so that lifting device 1000 can be conveniently maneuvered between physical locations. In one exemplary embodiment, wheels 1140 are spaced along base frame member 1102 to allow transport up a two foot wide ramp. Top frame 1200 comprises top frame members 1201, 1202, 1203, 1204, 1205, 1206, 1207, 1208 and 1209, which are fastened together in a well-known manner to form top frame 1200, such as by welding and/or by fastening devices such as, but not limited to, nuts and bolts, so that top frame 1200 comprises a U shape when viewed from above (FIG. 1D).

Base frame 1100 and top frame 1200 are attached to each other using vertical frame members 1301-1308, which extend between base frame 1100 and top frame 1200. In particular, vertical frame members 1301-1308 are fastened to base frame 1100 and top frame 1200 in a well-known manner, such as by welding and/or by fastening devices such as, but not limited to, nuts and bolts. The U-shape formed by base frame 110 and top frame 1200 form a load holding area 1400 (FIGS. 1D and 2D). It should be understood that for the exemplary embodiment shown in FIGS. 1A-1D and 2A-2D, there are base frame members, top frame members, and vertical frame members that are not shown in some and/or all of the Figures because they are hidden from view and, consequently, do not have specific reference numerals. Base frame members 1101, 1102, 1103, 1104, 1105, top frame members 1201, 1202, 1203, 1204, 1205, 1206, 1207, 1208 and 1209, and vertical frame members 1301-1308 could be formed from solid components, tubular components, channel components, and/or angle components. Accordingly, the different embodiments depicted in the Figures and described herein are interchangeably formed from solid components, tubular components, channel components, and/or angle components. In one exemplary embodiment, top frame members 1201, 1202 and 1205 are formed from a channel component have the capability to captively holding, for example, a fabric-type material that can be used for concealing the components forming frame 1001 from view. Additionally, base frame members, top frame members and vertical frame members could be formed from any material having sufficient strength and physical characteristics for handling the stresses that are expected to be experienced by lift device 1000.

Frame 1001 is attached to multi-stage masts 1002 and 1003 in a well-known manner, such as by welding and/or by fastening devices, such as, but not limited to, plates, nuts and bolts. It should be understood that frame 1001 could be configured differently from the exemplary configuration shown in FIGS. 1A-1D and 2A-2D and still provide the same structural benefits. As shown in FIGS. 1A-1C and 2A-2D, multi-stage masts 1002 and 1003 extend below base frame portion 1100 (in particular, see A in FIGS. 1B and 1C) in order to provide a maximal length of the stages respectively forming masts 1002 and 1003 with a corresponding minimal overall height of lifting device 1000 when masts 1002 and 1003 are in the non-telescoped position.

Fly bar 1004 spans between the tops of multi-stage masts 1002 and 1003, and comprises a span member 1800, eye bolts 1801 and a hoist mechanism 1802. (Note that fly bar 1004 is not shown in FIG. 1D for clarity.) The position of each eye bolt 1801 along the bottom of span member 1800 can be independently selected in a well-known manner so that they correspond to grasping holes in an object, such as a speaker and/or lights, that is/are suspended, or supported, from span member 1800 (see, for example, FIG. 2A). Once a position is selected for an eye bolt 1801, the eye bolt can be fastened in a well-known manner so that its position remains fixed until another position is desired. While only two eye bolts 1801 are shown, it should be understood that any number of eye bolts 1801 could be used.

In one exemplary embodiment, fly bar 1004 is removeably mounted on the tops of each multi-stage mast 1002 and 1003 by a pin 1820 (FIGS. 2E and 3A) that engages an aperture 1821 (FIGS. 2E and 3A) in the top of each multi-stage mast 1002 and 1003 in a well-known manner located on the top of each mast. It should be understood that other well-known techniques could alternatively be used for removeably mounting fly bar 1004 to the tops of multi-stage masts 1002 and 1003. As another alternative, fly bar 1004 could be removeably mounted to the side of multi-stage masts 1002 and 1003 using a well-known technique. In yet other exemplary alternative embodiments, fly bar 1004 is fixedly attached either to the tops or to the sides of multi-stage masts 1002 and 1003. One exemplary embodiment of fly bar 1004 comprises a length of a metal framing and hanging system, which is commonly known as Superstrut and available from, for example Thomas and Betts, among other suppliers. In one exemplary embodiment, the length of fly bar 1004 is not significantly greater than the distance between the outside edges of multi-stage masts 1002 and 1003. In another exemplary embodiment, the length of fly bar 1004 is greater than the distance between the outside edges of multi-stages masts 1002 and 1003. That is, for this alternative exemplary embodiment, fly bar 1004 extends beyond the outside edges of multi-stage masts 1002 and 1003. It should also be understood that fly bar 1004 could be configured to additionally and/or alternatively support an object above fly bar 1004, such as truss adapters that then in turn hold and support a truss system for holding items such as, but not limited to, lighting, banners, video monitors, projection screens, speakers, etc. Still in another exemplary embodiment, extension members (not shown) can be removeably attached to the top of each multi-stage mast 1002 and 1003 using, for example, a pin and aperture arrangement similar to that depicted in FIG. 3A, thereby lengthening each multi-stage mast by the length of the extension member. For this exemplary embodiment, fly bar 1004 is then removeably attached to the top of each extension member using for example, a pin and aperture arrangement similar to that depicted in FIG. 3A.

Hoist mechanism 1802 comprises a hook member 1803, a cable 1804, a cable spool 1805, a mounting bracket 1806 in which cable spool 1805 is mounted in a well-known manner, a mounting arm 1807 on which mounting bracket 1806 is fastened in a well-known manner, a crank arm 1808, and a sheave 1809. It should be understood that hoist mechanism 1802 may also comprise sheaves that are not indicated and/or that are not shown in the Figures. After the positions of eye bolts 1801 have been selected, hoist mechanism 1802 is used for raising an object-to-be-lifted and suspended from span member 1800. The object-to-be-lifted is positioned within load holding area 1400 (FIGS. 1D and 2D, i.e., the U shape formed by frame 1001), such as by moving the object into the U shape using a dolly. Alternatively, lift device 1000 could be moved and positioned so that load holding area 1400 surrounds the object-to-be-lifted. The U shape of frame 1001 provides the capability that lifting device 1000 be positioned in close proximate relationship to an object-to-be-lifted. It should be understood that the side members (for example, frame members 1102, 1103, 1104, 1105, 1202, 1203, 1204 and 1205) of frame 1001 are not required to have a length such that frame 1001 completely surrounds an object-to-be-lifted on three sides.

After the object-to-be-lifted is positioned within load holding area 1400, hook member 1803 is then lowered using hoist mechanism 1802 and used to hook the object. Hook member 1803 is then raised to a height that is suitable for connecting the object to eye bolts 1801 by winding cable 1804 onto spool 1805 using crank arm 1808. Clevis pins, chains, and/or shackles (not shown) could be used in a well-known manner for suspending the object-to-be-lifted from eye bolts 1801. It should be understood that other devices and/or techniques could be used in a well-known manner for fastening an object to and suspending the object from eye bolts 1801.

Multi-stage masts 1002 and 1003 telescope, or extend, between a non-telescoped position (FIGS. 1A-1D) (i.e., a first length configuration) and a telescoped position (FIGS. 2A-2C) (i.e., a second length configuration) using cable mechanism 1005. Cable mechanism 1005 comprises a dual cable spool 1006, cables 1007 and 1008, and a removable crank arm 1009. Cables 1007 and 1008 respectively have paths through sheaves and/or idler wheels that are external and/or internal to multi-stage masts 1002 and 1003. In the exemplary embodiment shown in FIGS. 1A-1D, the path of cable 1008 is across the front of lift device 1000 through sheaves 1381 and 1382, which are positioned behind cover plates 1383 and 1384, respectively. In an alternative embodiment, the path of cable 1008 could pass through at least a portion of base frame member 1101 in a well-known manner, such as when base frame member 1101 is configured as a channel component or as a tubular component. In yet another alternative embodiment, the respective paths of cables 1007 and 1008 could be positioned behind cover plates so that they are completely or mostly out of view. It should be understood that cables 1007 and 1008 could have paths that are different from the paths depicted in FIGS. 1A-1D and 2A-2D and still provide the same structural benefits.

As shown in the exemplary embodiment of FIGS. 1A-1D and 2A-2D, cables 1007 and 1008 are respectively wound onto and unwound from dual cable spool 1006 using crank arm 1009 in a well-known manner so that multi-stages masts 1002 and 1003 are raised and lowered between the non-telescoped position and the telescoped position simultaneously and substantially in unison. In another exemplary embodiment, the respective relative lengths of cables 1007 and 1008 can be adjusted so that as cables 1007 and 1008 are wound onto and unwound from dual spool 1006, multi-stage masts 1002 and 1003 are raised and lowered between the non-telescoped position and the telescoped position simultaneously and substantially in unison so that fly bar 1004 remains substantially horizontal. In yet another exemplary alternative embodiment, cables 1007 and 1008 could be replaced by a single cable that has a cable path through sheaves and/or idler wheels and through multi-stage masts 1002 and 1003 so that as the single cable is wound onto and unwound from a single spool multi-stages masts 1002 and 1003 are raised and lowered between the non-telescoped position and the telescoped position simultaneously and substantially in unison. As yet a further alternative embodiment, it should be understood that the subject matter disclosed herein is not limited to two multi-stage masts, but could comprise two or more multi-stage masts. In still another exemplary alternative embodiment, spool 1006 can be motor driven in a well-known manner.

Figure 1B:
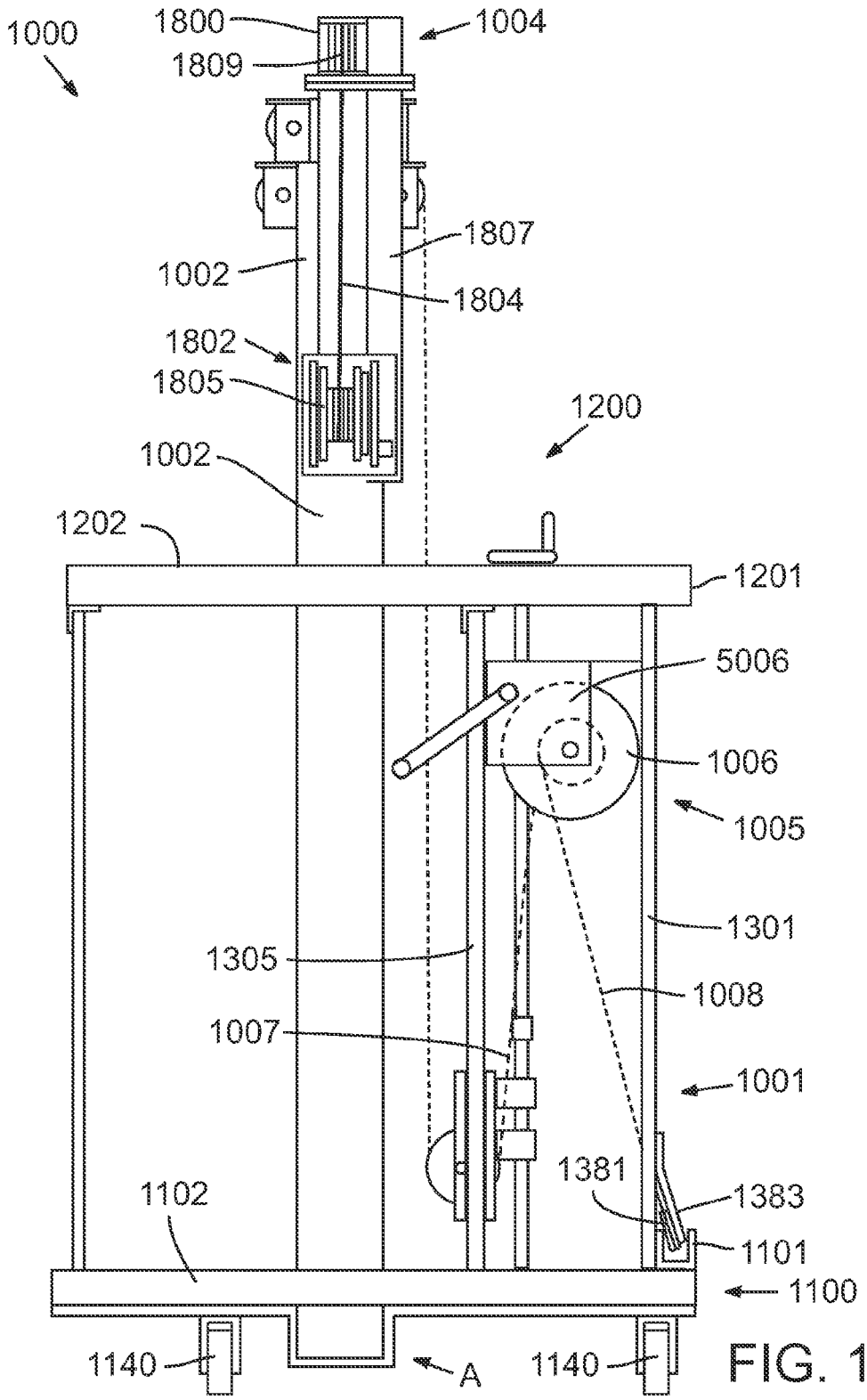
Figure 1C:
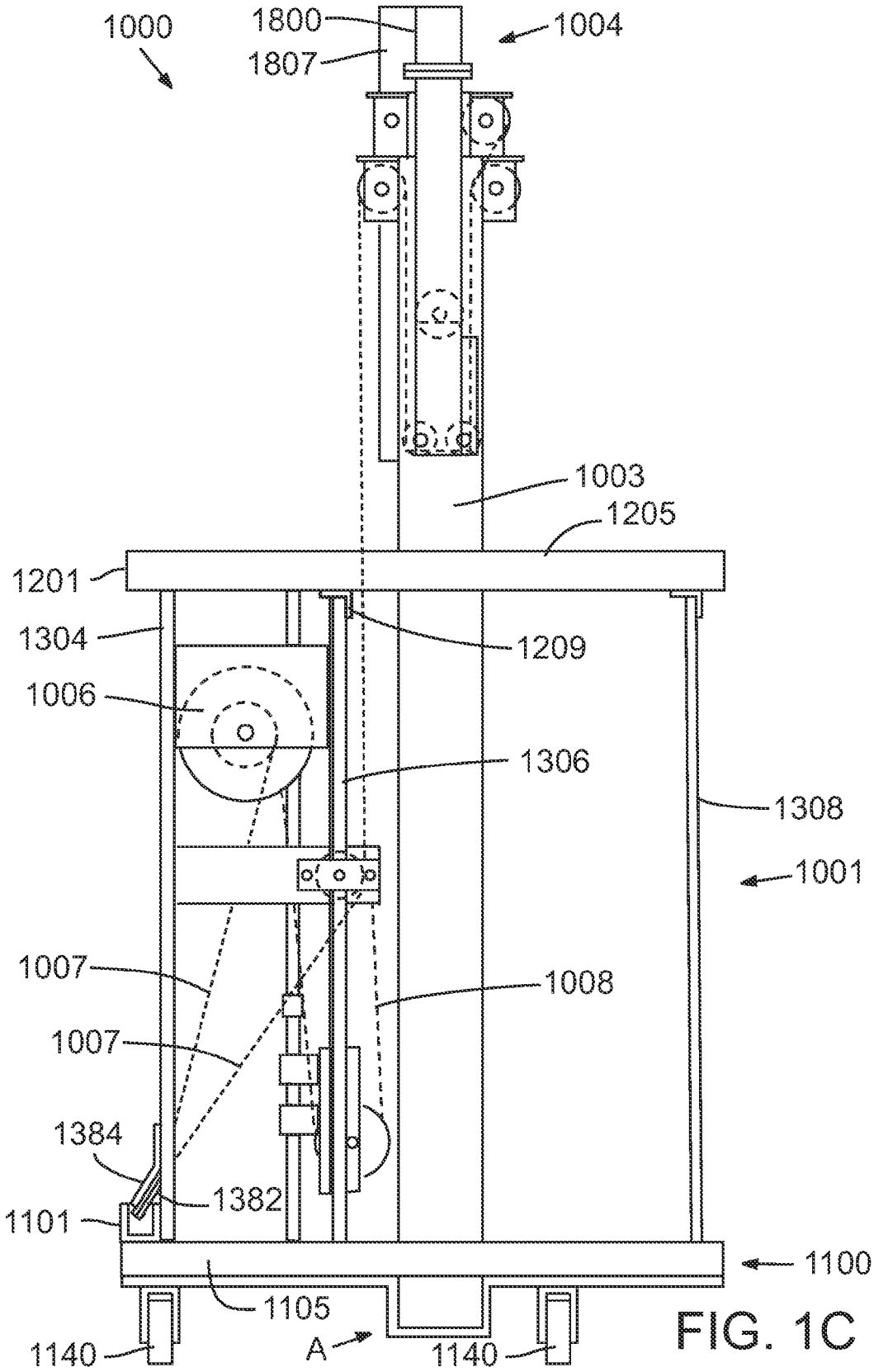
Figure 1D:
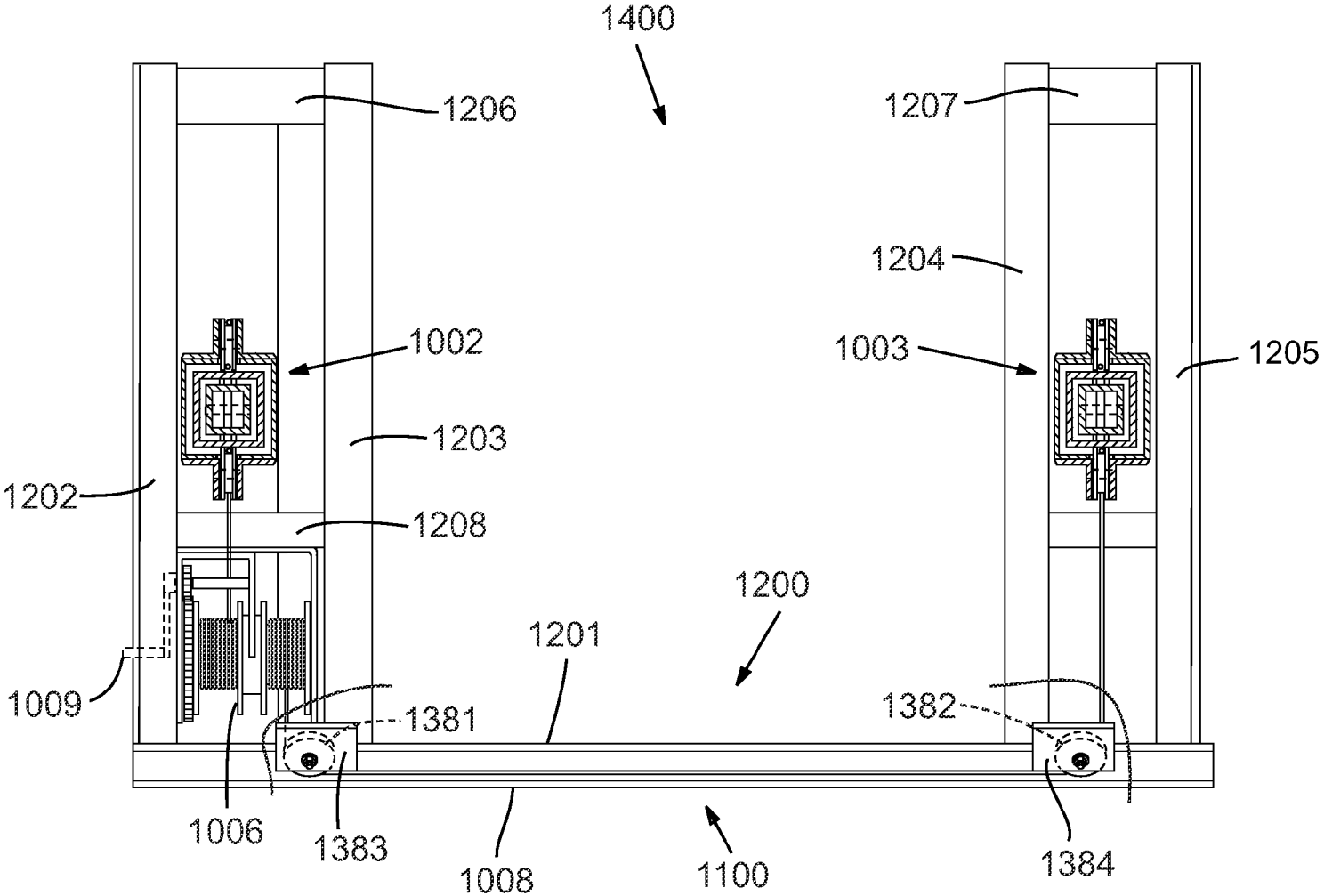
Figure 2A:
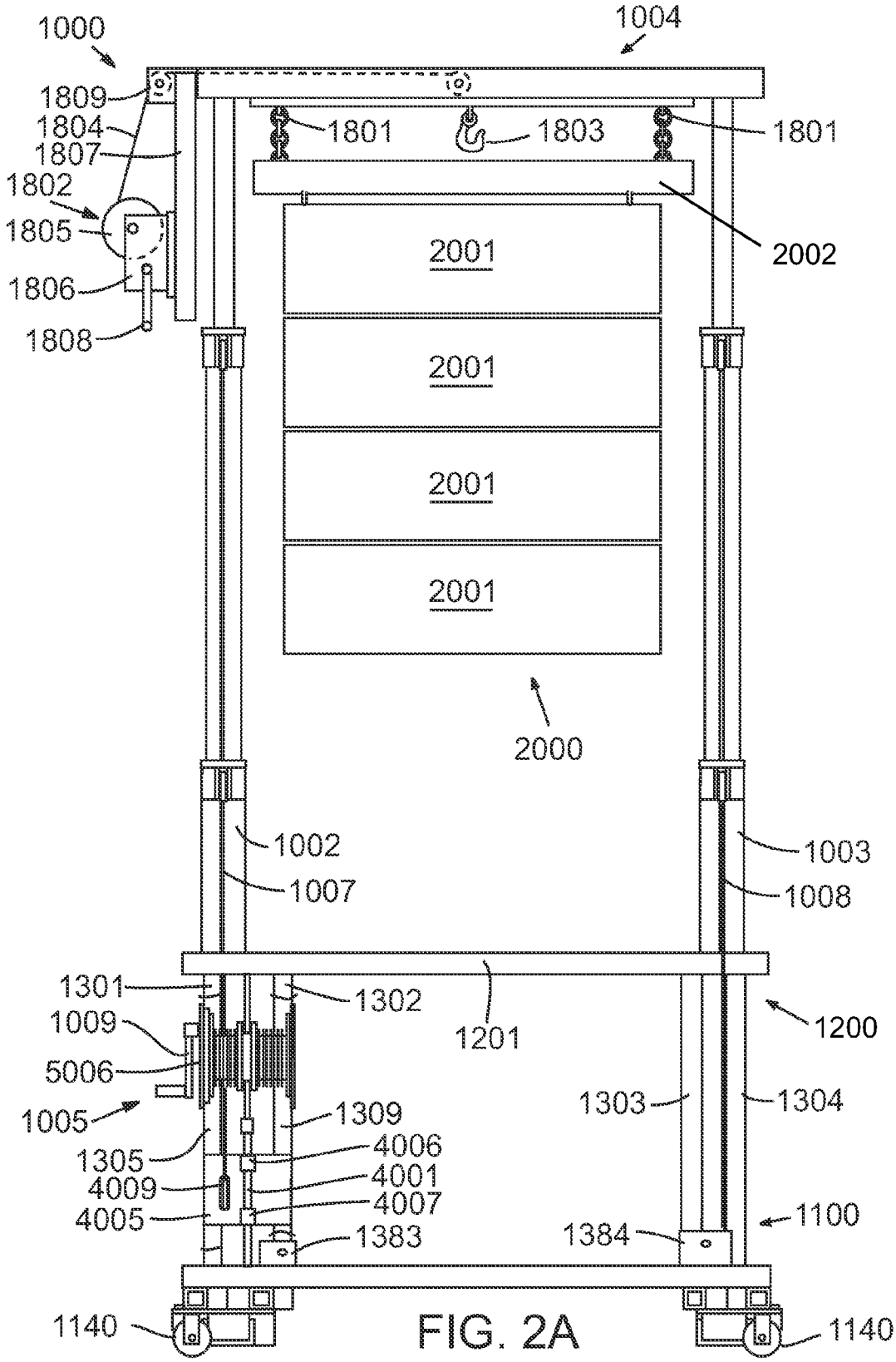
FIGS. 2A-2C respectively depict front, left, right views of the exemplary embodiment of lifting device of FIGS. 1A-1C in a telescoped position lifting an exemplary object according to the subject matter disclosed herein.
Figure 2B:
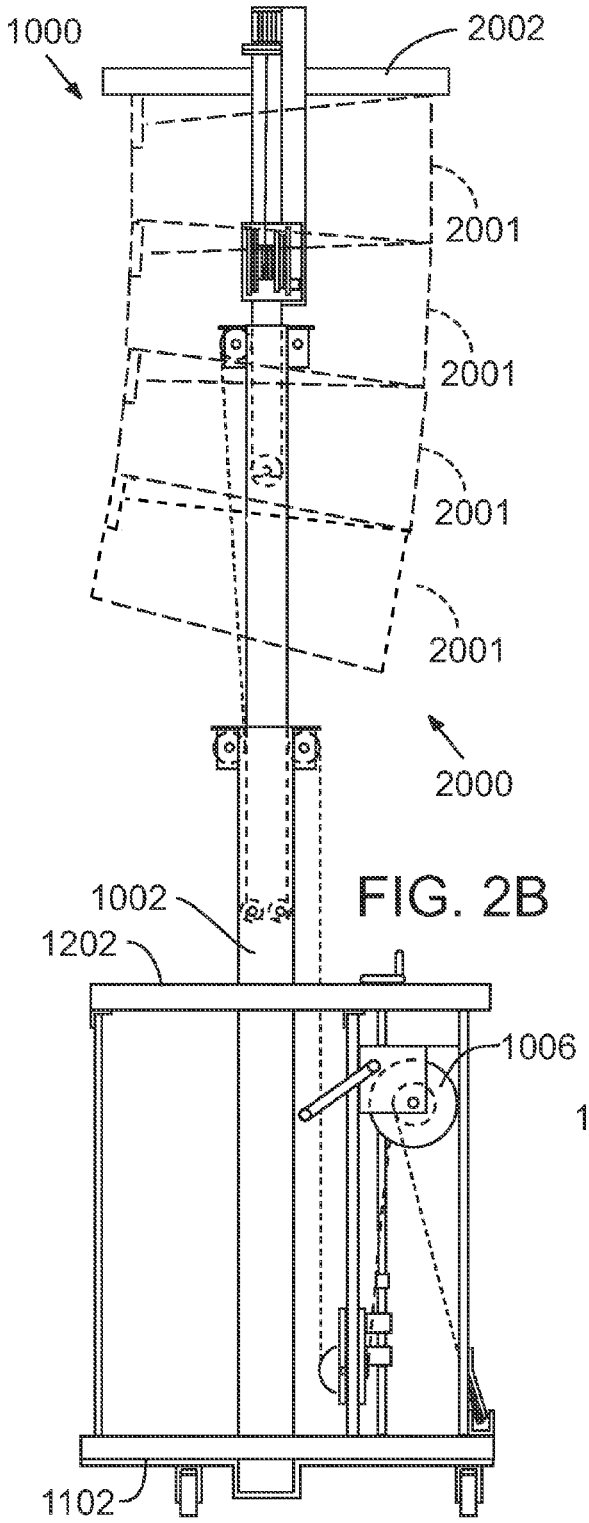
Figure 2C:
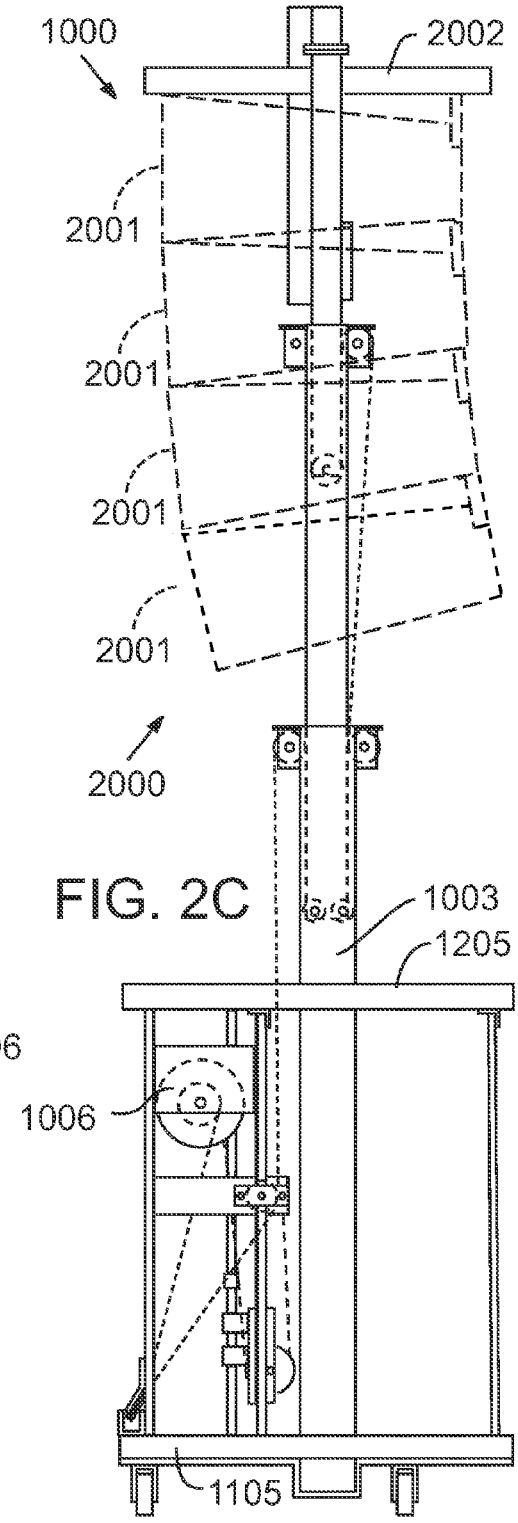
Figure 2D:
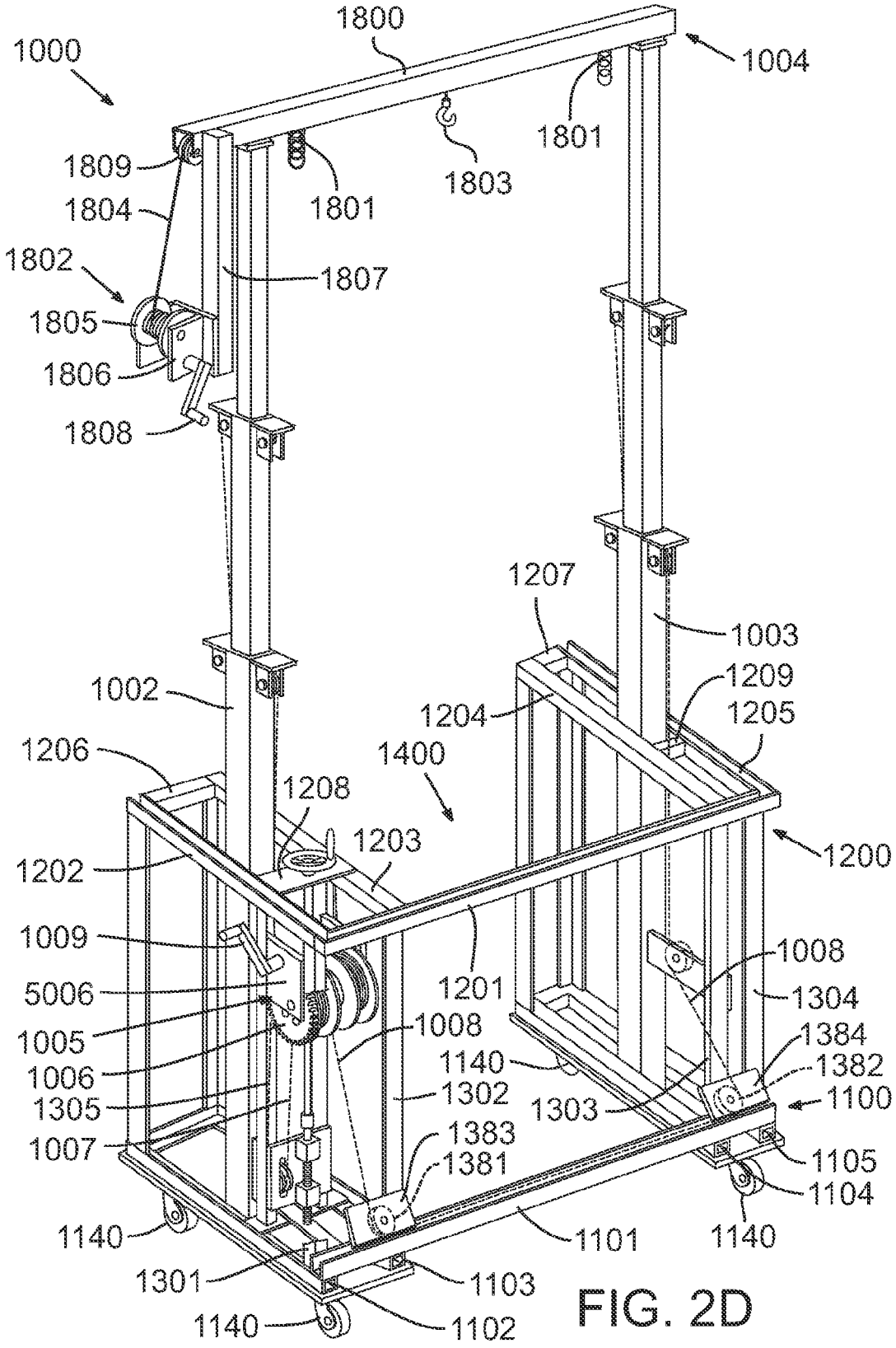
FIG. 2D depicts a perspective view of the exemplary embodiment of the lifting device in which the multi-stage masts are in a telescoped configuration according to the subject matter disclosed herein.
Figure 2E:
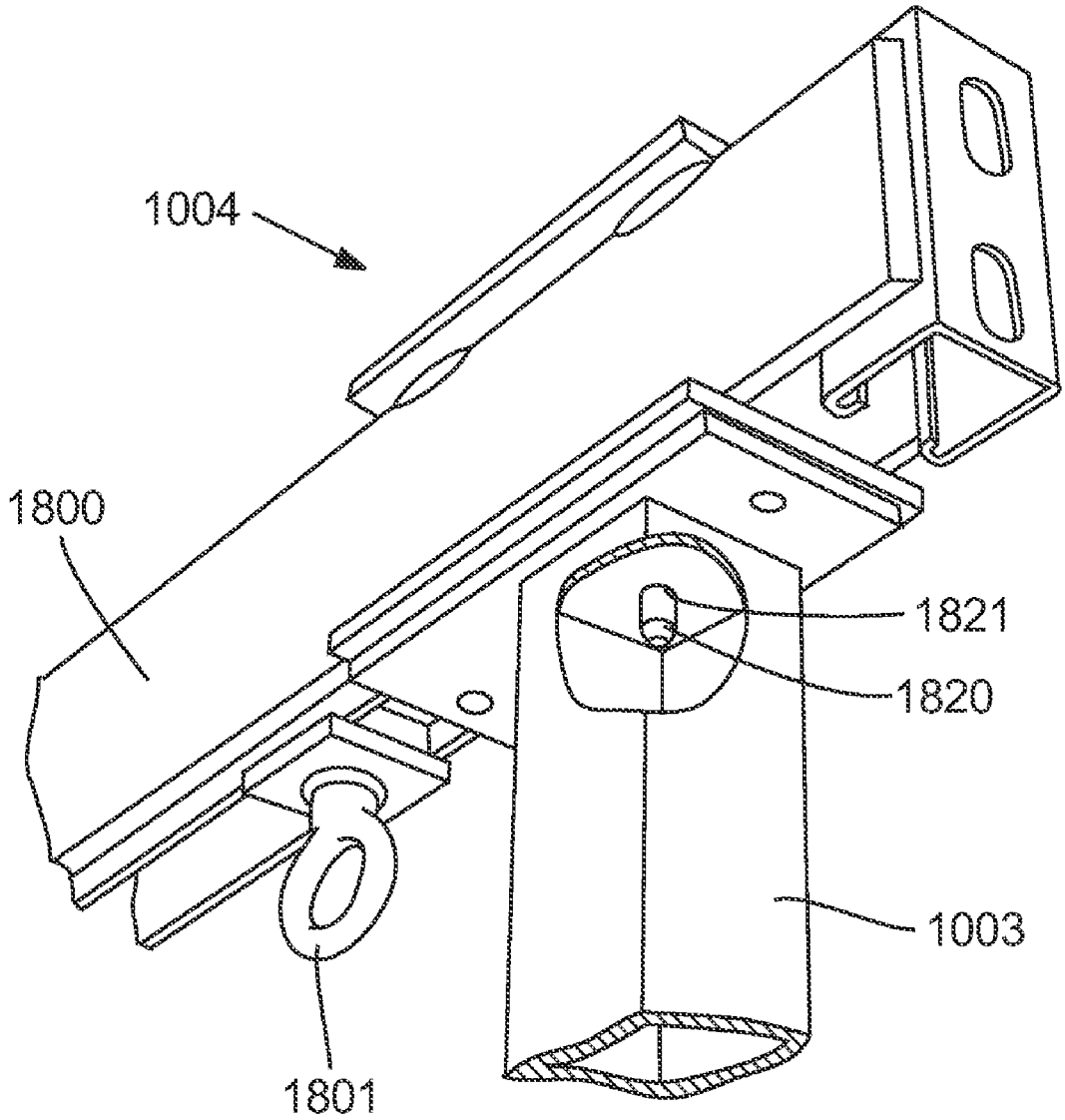
FIG. 2E depicts a cutaway perspective view from below of an exemplary embodiment of a multi-stage mast and a fly bar according to the subject matter disclosed herein.

FIGS. 2A-2C respectively depict front, left, right views of the exemplary embodiment of lifting device 1000 of FIGS. 1A-1C in a telescoped position lifting an exemplary object 2000 according to the subject matter disclosed herein. Exemplary object 2000 can comprise a line-array speaker module comprising a plurality of speaker modules 2001. Line-array speaker module 2000 is suspended from a speaker bumper 2002 that is configured for attachment to line-array speaker module 2000 in a well-known manner. Speaker bumper 2002 is suspended from eye bolts 1801 in a well-known manner, such as by, but not limited to, using shackles, chains, and/or clevis pins (not specifically indicated in the Figures). Note that part of frame 1001 in FIG. 2A has been removed so that dual cable spool 1006 is visible.

Figure 3A:
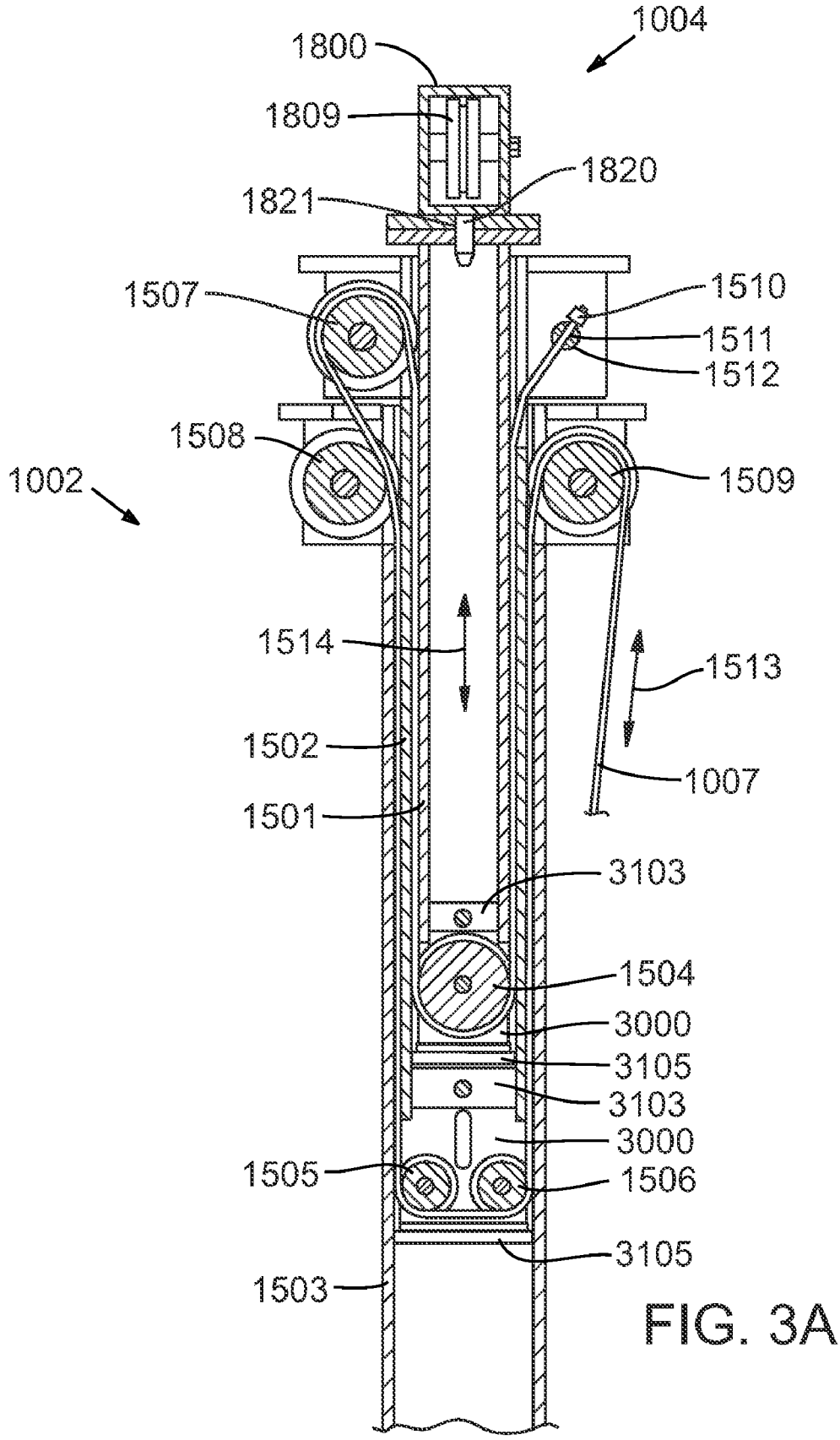
FIG. 3A depicts a cross-sectional view of a portion of one exemplary embodiment of a multi-stage mast according to the subject matter disclosed herein.

FIG. 3A is depicts a cross-sectional view of a portion of one exemplary embodiment of a multi-stage mast 1002 according to the subject matter disclosed herein. Multi-stage mast 1002 is depicted in a non-telescoped position in FIG. 3A. It should be understood that multi-stage mast 1003 is typically configured in a similar manner to the exemplary embodiment shown for multi-stage mast 1002, and thereby operates in a similar manner to multi-stage mast 1002. As shown in FIG. 3A, multi-stage mast 1002 comprises stages 1501, 1502 and 1503. In particular, when multi-stage mast 1002 is in the non-telescoped position, stage 1503 surrounds most of the length of stage 1502, which, in turn, surrounds most of the length of stage 1501. The materials and the respective dimensions and wall thickness of stages 1501-1503 are accordingly selected based on the stresses that stages 1501-1503 are expected to experience and so that stage 1501 fits inside stage 1502, and so stage 1502 fits inside stage 1503. Additionally, it should be understood that there is sufficient clearance within stages 1502 and 1503 for cable 1007, as will become clearer in the following description. In one exemplary embodiment, stages 1501-1503 are formed from aluminum. For that exemplary embodiment, stage 1501 has a nominal width of 2", a nominal depth of 2", a nominal length of 59", and a nominal wall thickness of 0.250"; stage 1502 has a nominal width of 3", a nominal depth of 3", a nominal length of 63", and a nominal wall thickness of 0.125"; and stage 1503 has a nominal width of 4", a nominal depth of 4", a nominal length of 63", and a nominal wall thickness of 0.125".

Stage 1501 comprises one sheave 1504 that is depicted in FIG. 3A as being positioned at the bottom end of stage 1501. Sheave 1504 is attached to stage 1501 in a well-known manner, such as by using a mounting plate 3000 (FIGS. 3C-3E), and is selected to have a size that allows clearance from the internal dimensions of stage 1502. Stage 1502 comprises two sheaves 1505 and 1506 that are positioned at the bottom end of stage 1502, and one sheave 1507 positioned near the top of stage 1502. Sheaves 1505 and 1506 are attached to stage 1502 in a well-known manner, such as by using a mounting plate 3000 (FIGS. 3C-3E), and are selected to have a size that allows clearance from the internal dimensions of stage 1503. It should be understood that a single sheave could be used in place of sheaves 1505 and 1506, but it should be kept in mind that the size of the single sheave would require a larger space between the bottom of stage 1501 and the bottom of stage 1502, and thereby reduce the overall telescoping length of multi-stage mast 1002 in comparison to using two sheaves. Sheave 1507 is attached near the top of stage 1502 in a well-known manner. Stage 1503 comprises sheaves 1508 and 1509 that are both attached to stage 1503 in a well-known manner near the top of stage 1503. In one exemplary embodiment, sheaves 1504-1509 are aligned along a centerline of stages 1501-1503. In another exemplary embodiment, sheaves 1504-1509 are aligned along a line that is not a centerline of stages 1501-1503.

Figure 4A:
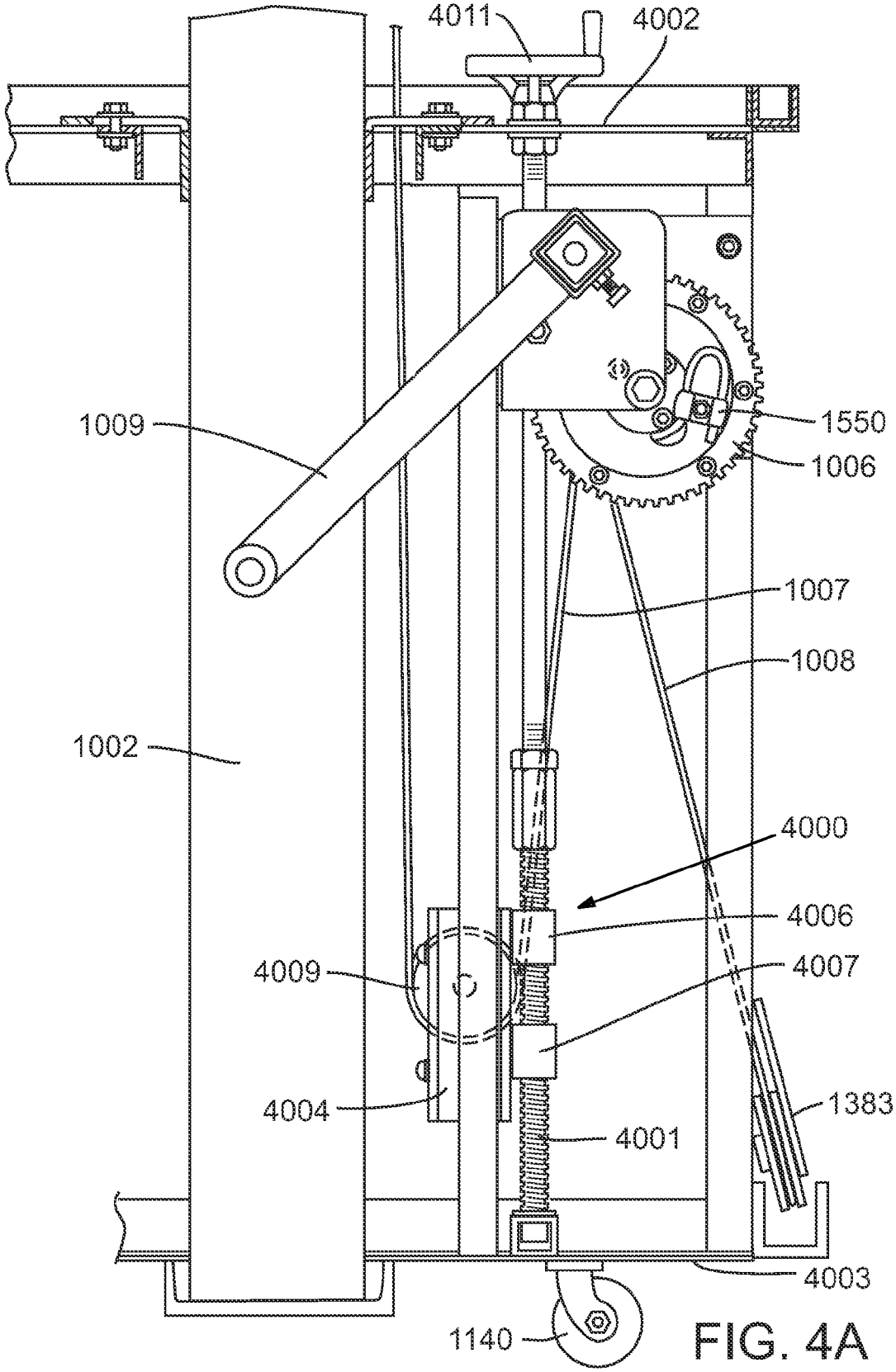
FIGS. 4A and 4B depict different views of a fine-adjustment mechanism according to the subject matter disclosed herein.

Cable 1007 is attached to the top end of stage 1502 in a well-known manner, such as by using a cable stop 1510 that is too large to pass through an aperture 1511 in a pin 1512. Cable 1007 is arranged from pin 1512 to enter the space between stages 1501 and 1502 and pass around sheave 1504 at the bottom of stage 1501. Cable 1007 then is directed upward to pass around sheave 1507 positioned towards the top end of stage 1502. From sheave 1507, cable 1007 is directed by sheave 1508 to enter the space between stages 1502 and 1503 and then pass around sheaves 1505 and 1506 at the bottom end of stage 1502. From sheave 1506, cable 1007 is directed upward to pass around sheave 1509 located towards the top end of stage 1503, and then around a sheave 4009 (FIGS. 4A and 4B) before being directed to spool 1006*a* of dual cable spool 1006. Cable 1007 is attached to spool 1006*a* in a well-known manner, such as by a cable clamp mechanism 1550 (FIG. 4A). It should be understood that cable 1008 is arranged in multi-stage mast 1003 in a manner similar to cable 1007. It should also be understood that cable 1007 and/or 1008 could be replaced by a chain or other suitable line or device. In the alternative embodiment in which a single cable is used, the cable would be configured to extend beyond cable stop 1510 (FIG. 3A) and be directed downwardly to frame 1001 and then to have a cable path through multi-stage mast 1003.

Figure 3B:
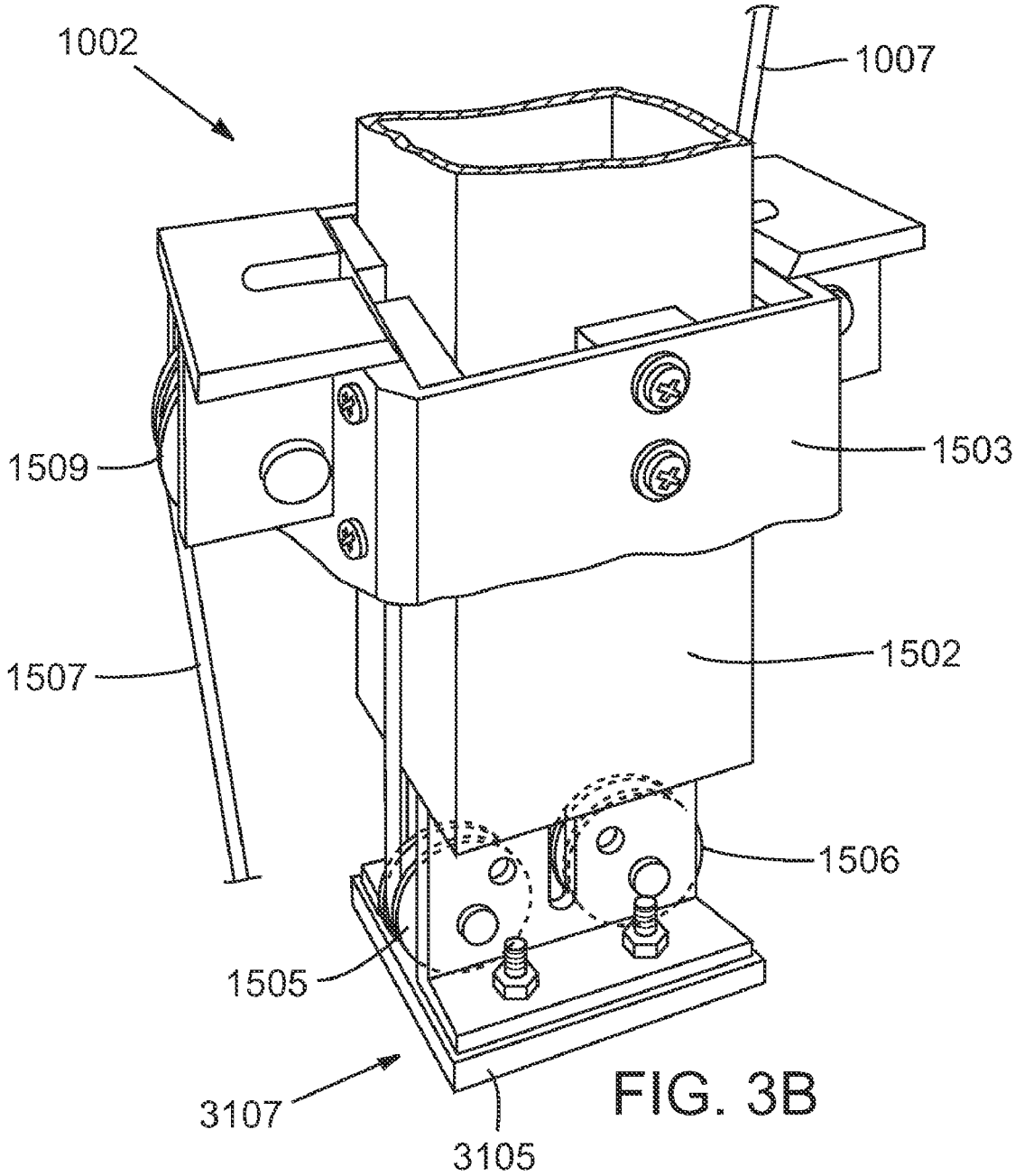
FIG. 3B shows a portion of an exemplary stage of a multi-stage mast in a telescoped configuration near the top of an outer stage of the mast.

As cable 1007 is wound onto dual cable spool 1006, the effective length of cable 1007 through sheaves 1504-1509 becomes shorter (as indicated by downward portion of arrow 1513), thereby causing stages 1501 and 1502 to respectively telescope out of stages 1502 and 1503 (as indicated by upward portion of arrow 1514). FIG. 3B shows a portion of an exemplary stage 1502 in a telescoped configuration near the top of stage 1503, which is shown as partially cut away. Surface portion 3005*a* of flange portions 3005 of mounting plates 3000 respectively extend beyond the exterior dimension of stages 1501 and 1503 and engage bottom surfaces (not indicated) in a well-known manner that are located at the top of stages 1502 and 1503 to prevent stages 1501 and 1502 from telescoping completely out of stages 1502 and 1503. As cable 1007 is unwound from dual spool 1006, the effective length of cable 1007 through the sheaves becomes longer (as indicated by upward portion of arrow 1513) thereby causing stages 1501 and 1502 to respectively retract into stages 1502 and 1503 (as indicated by downward portion of arrow 1514). It should be understood that while multi-stage masts 1002 and 1003 are depicted as having three stages, any number of stages could be used. That is, multi-stage masts 1002 and 1003 could be formed from two or more stages.

Figure 3C:
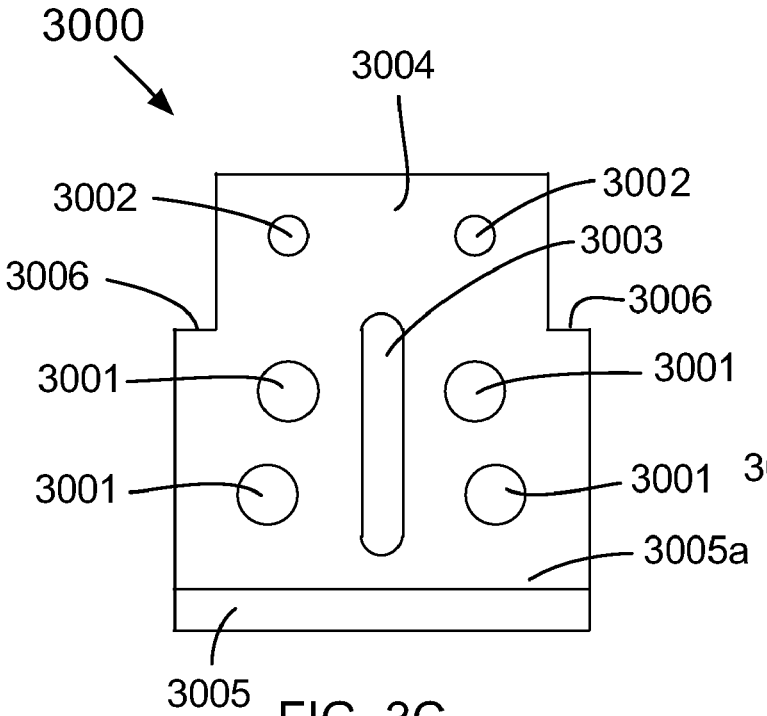
FIGS. 3C-3E respectively show front, side and bottom views of an exemplary embodiment of a mounting plate that can be used in a number of places on a lift device according to the subject matter disclosed herein.
Figure 3D:
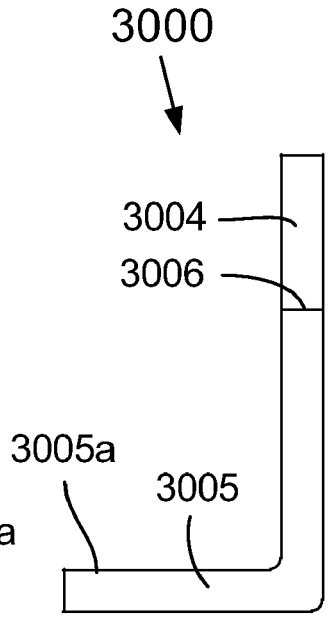
Figure 3E:
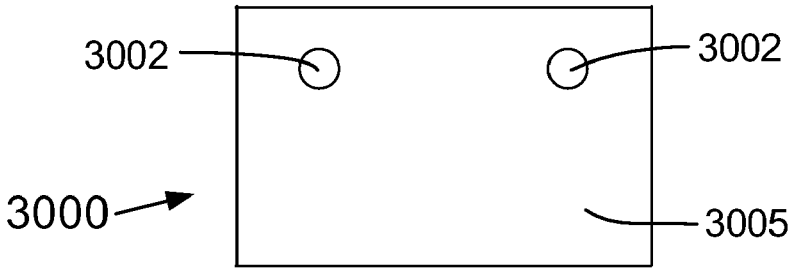

FIGS. 3C-3E respectively show front, side and bottom views of an exemplary embodiment of a mounting plate 3000 that can be used in a number of places on lift device 1000 according to the subject matter disclosed herein. Mounting plate 3000 comprises a plurality of apertures 3001, a plurality of apertures 3002, a slot 3003, a tab portion 3004, a flange portion 3005 and shoulder portions 3006. In one exemplary embodiment, apertures 3001 can be used for mounting pins on which sheaves, such as sheaves 1504-1506 (FIG. 3A), are mounted. In one exemplary embodiment, apertures 3002 can be used for fastening members, such as bolts or screws, for fastening a low-friction spacer material, such as a polyethylene material, to form an assembly 3100 (FIGS. 3C-3E) that can be fastened to the bottoms of stages 1501 and 1502. In one exemplary embodiment, slot 3003 can be used for mounting a single sheave when assembly 3100 is configured for a single sheave. In another exemplary embodiment, slot 3003 can be used for a path that allows cables 1007 and 1008 to facilitate cable redirection between stages of multi-stage masts 1002 and 1003 when mounting plate 3000 is used as a vertical-orientation adjustment shim. Slot 3003 also allows a mechanism for allowing adjustment when the mounting plate is used for an exterior vertical adjustment shim on two opposite sides of multi-stage mast. Accordingly, a frame-mounted bolt can be loosened to allow the mounting plate to slide back and forth in order to adjust the vertical plumb orientation of the multi-stage mast.

Figure 3F:
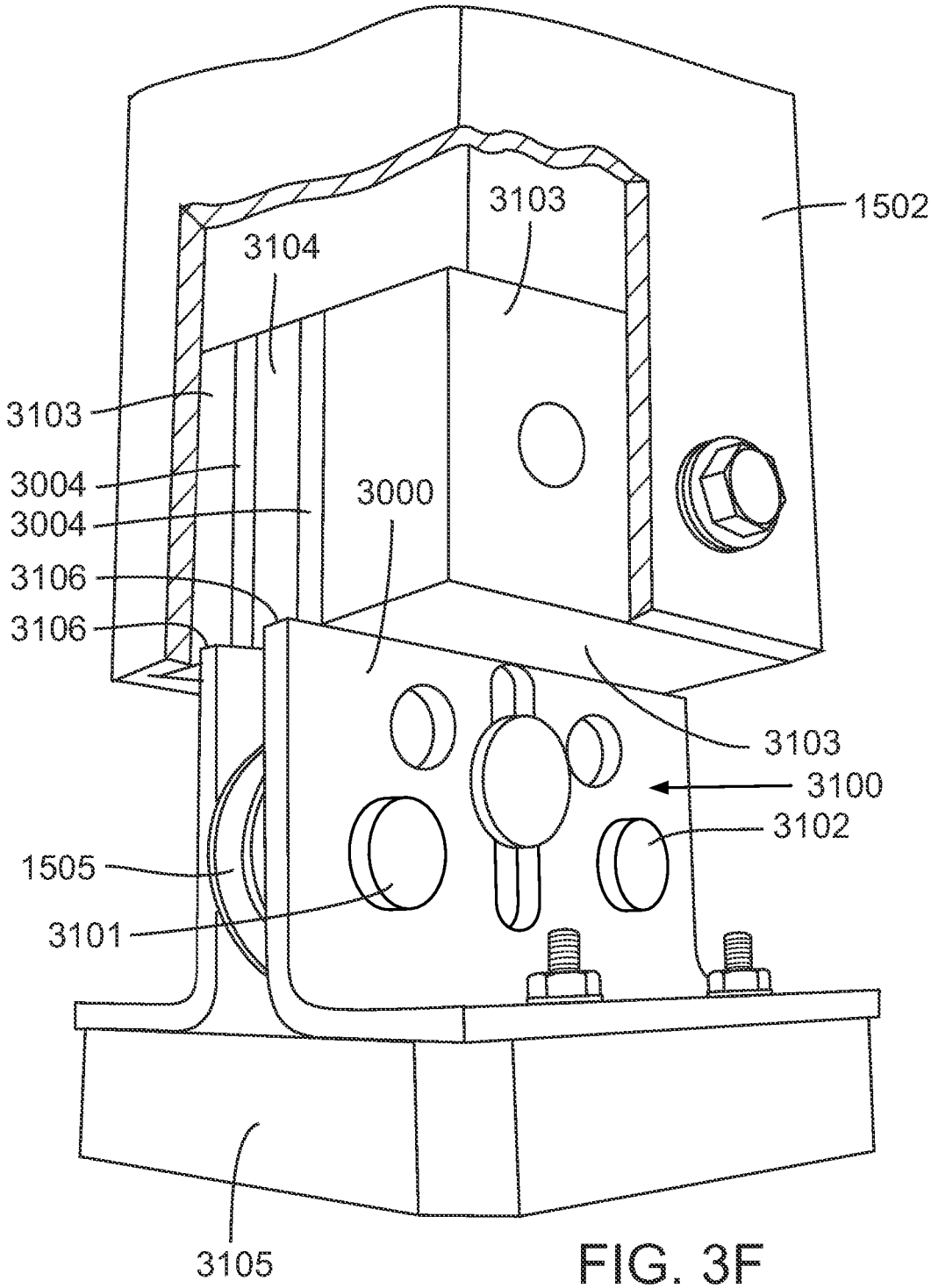
FIG. 3F depicts a perspective view of a sheave assembly mounted to the bottom of a stage according to the subject matter disclosed herein.

FIG. 3F depicts a perspective view of an assembly 3100 mounted to the bottom of a stage 1502 according to the subject matter disclosed herein. Assembly 3100, in particular, is configured for insertion into the bottom of stage 1502 and for respectively supporting sheaves 1505 and 1506 on pins 3101 and 3102, which serve as axles. Tab portion 3004 of each mounting plate 3000 of assembly 3100 fits into the bottom end of stage 1502 up to shoulder 3006. Tab portion 3004 of each mounting plate 3000 is fastened to stage 1502 using a well-known technique, such as by welding and/or by using fastening devices such as, but not limited to, nuts and bolts, which engage apertures 3002 on mounting plate 3000 and corresponding apertures in stage 1502. Assembly 3100 further comprises low-friction spacers 3103-3105 that are used for sizing assembly 3100 so that when assembly 3100 is mounted to the bottom of stage 1502, the top portion of assembly 3100 fits inside the bottom of stage 1502 and the bottom portion 3107 (See FIG. 3B) of assembly 3100 fits inside stage 1503. It should be noted that various fastener devices, such as bolts, washers, nuts and/or screws are depicted in FIG. 3F, but have not been given reference numerals. Accordingly, it should be understood that the configuration of the fastener devices could be different from the exemplary configuration depicted in FIG. 3F. While mounting plates 3000 and assembly 3100 are depicted as being configured for mounting on the bottom of stage 1502, it should be understood that mounting plates 3000 could have a size that is suitable for forming an assembly that mounts to the bottom of stage 1501.

Figure 4B:
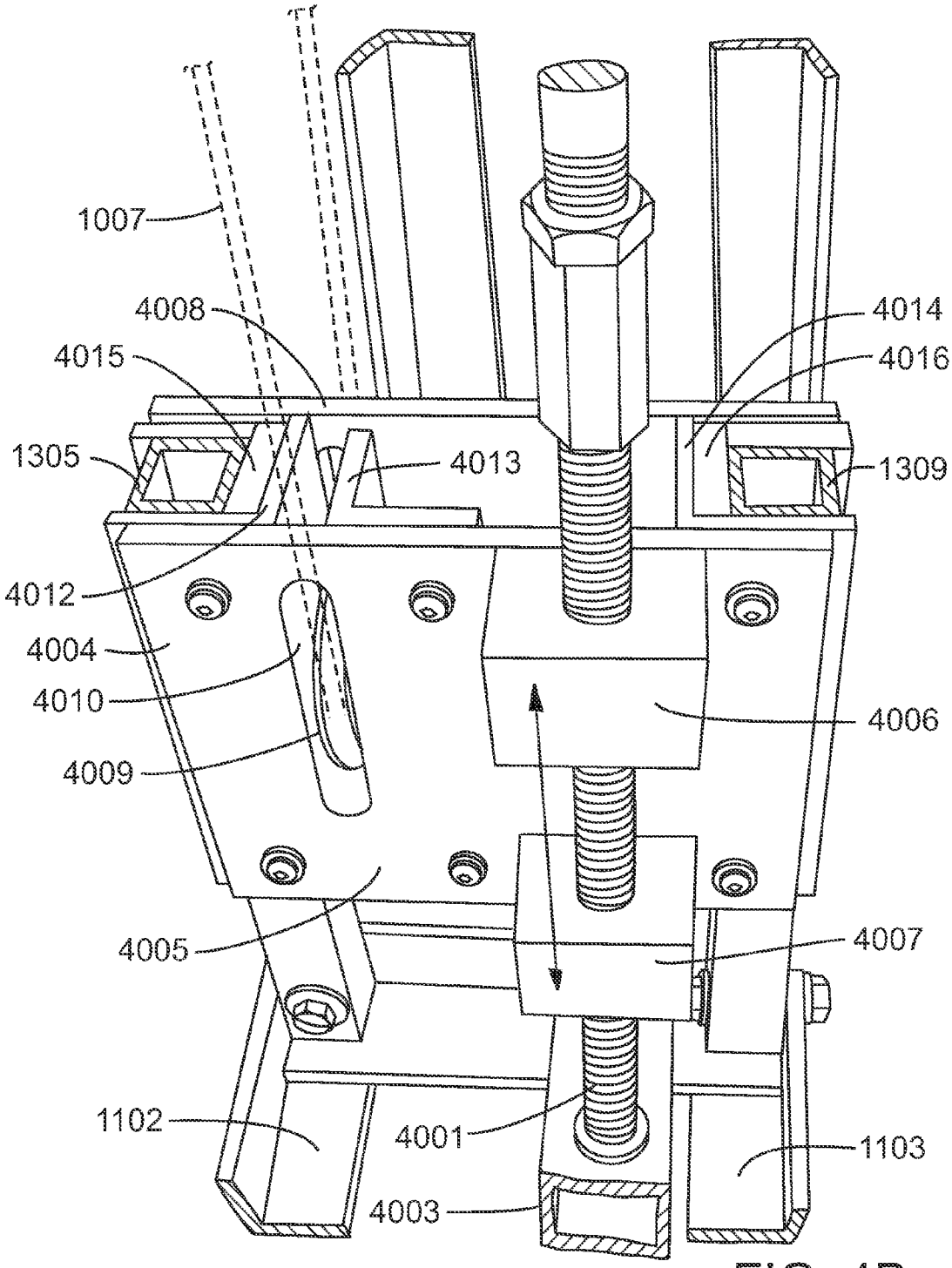

Because of the two-spool nature of wench/hoist mechanism 1006, it is possible that winding/unwinding speed differences are encountered between cables 1007 and 1008 respectively winding/unwind onto/from spools 1006*a* and 1006*b* (FIG. 5) due to constantly varying effective circumferences of spools 1006*a* and 1006*b*. The winding/unwinding speed differences may cause multi-stage masts 1002 and 1003 to ascend or descent to respectively different heights, and thereby cause fly bar 1004 to not be substantially level. Therefore, in order to minimize this potential situation, a fine-adjustment mechanism 4000 is provided for minimizing the potential height differences between multi-stage masts 1002 and 1003. One exemplary embodiment of a fine-adjustment mechanism 4000 is shown in FIGS. 4A and 4B.

Fine-adjustment mechanism comprises an acme screw 4001 (also referred to as an Acme-threaded rod 4001) that spans between a top support member 4002 and a base support member 4003, and adjustable sheave assembly 4004. Adjustable sheave assembly 4004 comprises a front plate 4005 that threadingly engages acme screw 4001 with internal-threaded members 4006 and 4007, a back plate 4008, a sheave 4009, an aperture 4010 and a crank wheel 4011. Back plate 4008 comprises an aperture that corresponds to aperture 4010, but is not indicated. Adjustable sheave assembly 4004 is attached to frame 1001 in a well-known manner using, for example, angle members, tubular members, plate members, bolts, nuts, screws and/or welds. Sheave 4009 is attached to assembly 4004 using angle members 4012 and 4013 in a well-known manner. Assembly 4004 further comprises an angle member 4014 disposed distally from angle members 4012 and 4013 that provides spacing support between front plate 4006 and back plate 4008. Adjustable sheave assembly 4000 is held in place against and between vertical frame members 1305 and 1309 by virtue of the position of acme screw 4001 and internal-threaded members 4006 and 4007. Pieces of a lubricating material 4015 and 4016, such as polyethylene, are disposed between vertical frame member 1305 and angle member 4012, and vertical frame member 1309 and angle member 4014 to minimize the friction that is generated between angle members 4012 and 4014 and the vertical frame members.

The path of cable 1007 is from spool 1006*a* through aperture 4010 around sheave 4009 and then to sheave 1509 (FIG. 3A) of multi-stage mast 1002. After a particular height of telescoped multi-stage masts 1002 and 1003 has been chosen using cable mechanism 1005, crank wheel 4011 is manually operated in a well-known manner to adjust the relative vertical position of adjustable sheave assembly 4004 along acme screw 4001, thereby adjusting the effective length of cable 1007 with respect to the length of cable 1008. That is, the relative vertical position of adjustable sheave assembly 4004 is adjusted so that the height of multi-stage mast 1002 is changed independently from the height of multi-stage mast 1003, thereby making fly bar 1004 substantially level. Fine-adjustment mechanism 4000 can be operated with multi-stage mast 1002 at any height.

It should be understood that a fine-adjustment mechanism could alternatively or additionally be configured to adjust the effective length of cable 1008 with respect to the effective length of cable 1007. By keeping crank wheel 4011 on the left side of lift device 1000, however, fine-adjustment mechanism 4000 is positioned on the same side of the lift device as crank arm 1009, thereby facilitating ease of use and a reduced time needed for lifting and adjusting a load. While fine-adjustment mechanism 4000 has been described as being a manually driven mechanism, it should be understood that a power linear actuator could alternatively be used for varying the position of sheave 4009. Further, as an alternative exemplary embodiment, a fine adjust mechanism could be configured to adjust the effective length of cable 1007 with respect to the effective length of cable 1008 (or, alternatively, to adjust the effective length of cable 1008 with respect to the length of cable 1007) by positioning an adjustable position sheave in a horizontal direction and/or a combination of a horizontal and vertical direction.

Figure 5:
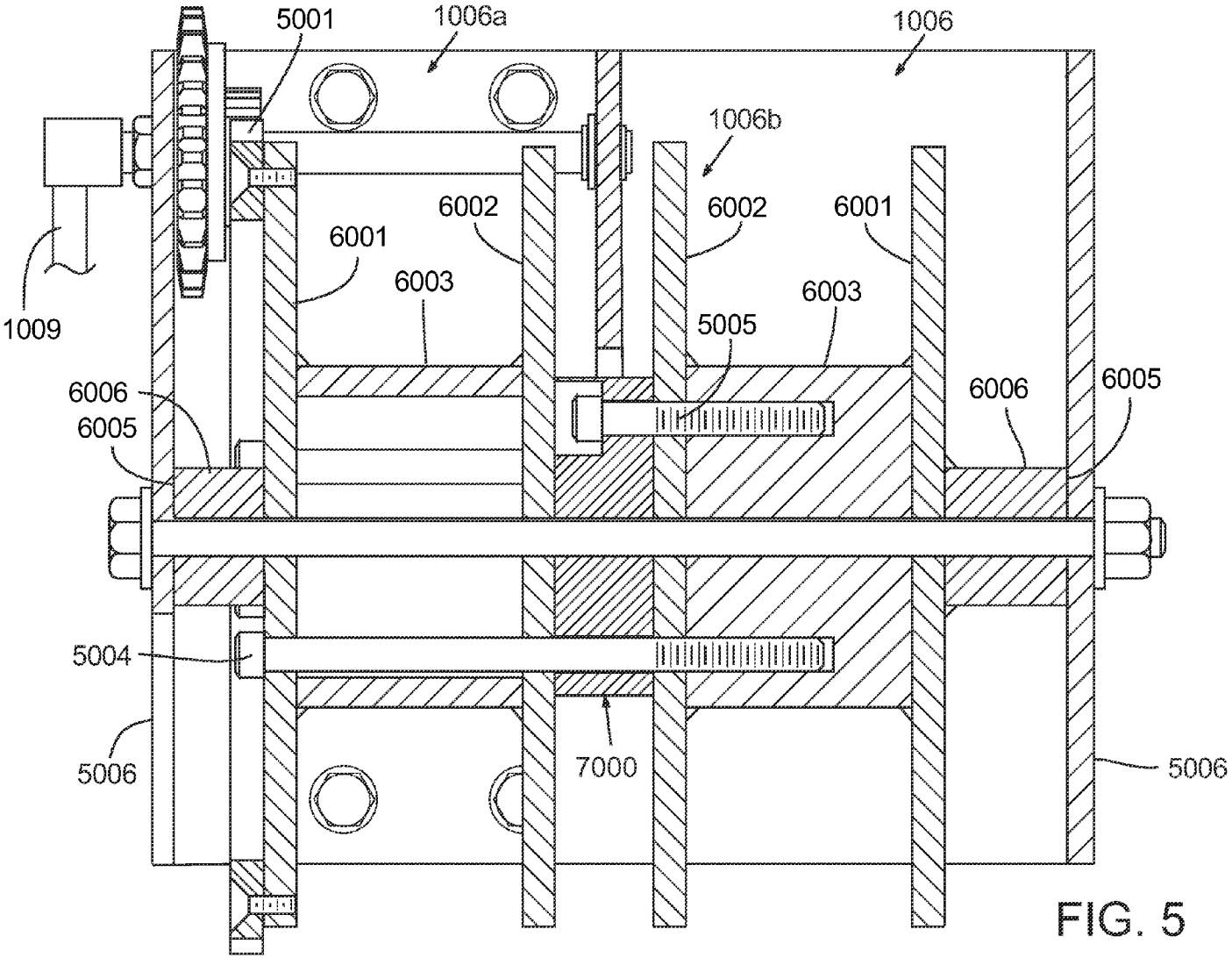
FIG. 5 shows a cross-sectional view of one exemplary embodiment of dual cable spool that is mounted in a bracket according to the subject matter disclosed herein.
Figure 6A:
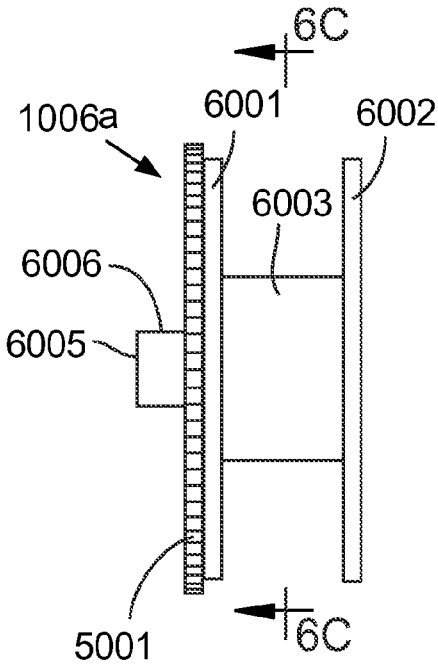
FIGS. 6A-6C respectively show side, end and cross-sectional views of an exemplary embodiment of first spool according to the subject matter disclosed herein.
Figure 6B:
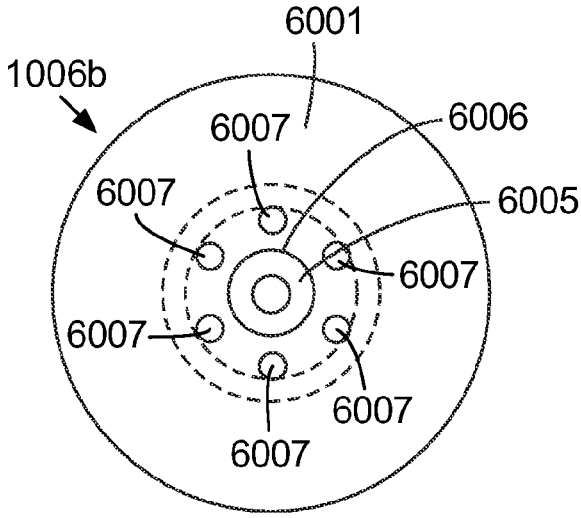
Figure 6C:
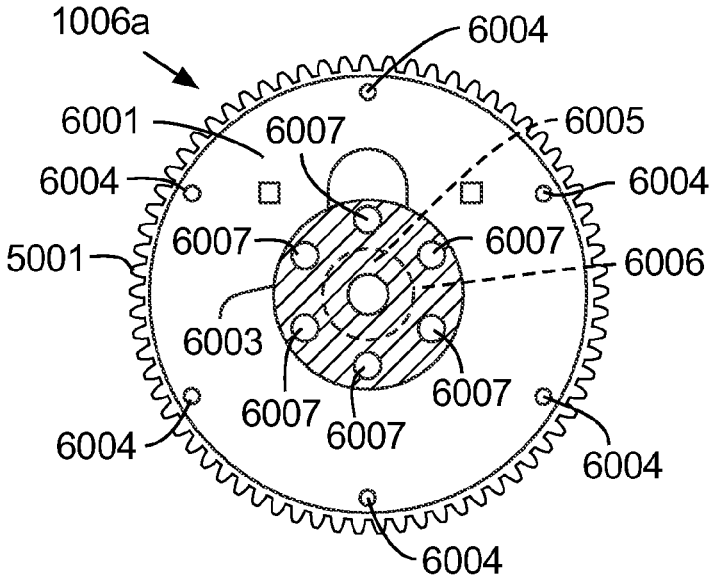
Figure 7A:
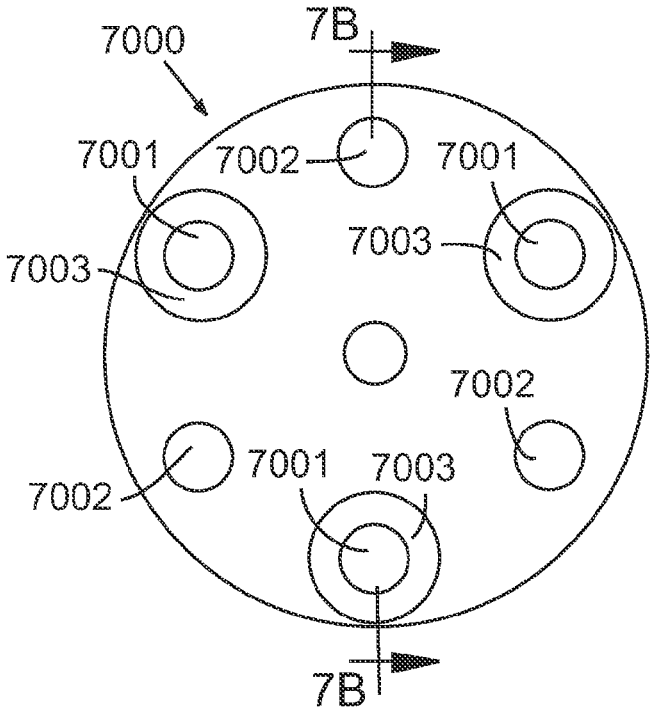
FIGS. 7A and 7B respectively show a front view and a cross-sectional view of an exemplary embodiment of a spacer according to the subject matter disclosed herein.
Figure 7B:
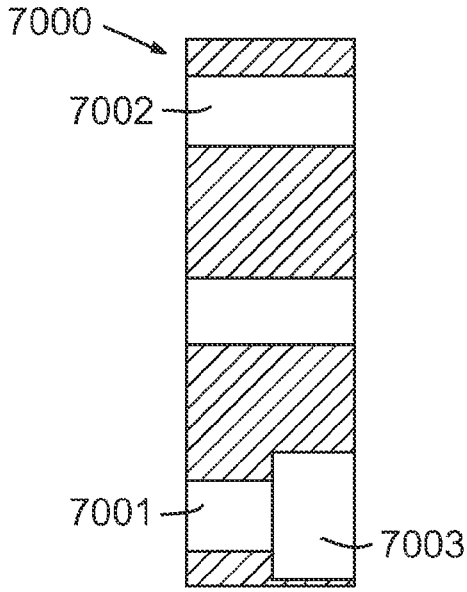

FIG. 5 shows a cross-sectional view of one exemplary embodiment of dual cable spool 1006 that is mounted in a bracket 5006 according to the subject matter disclosed herein. Dual cable spool 1006 comprises a first spool 1006*a* for cable 1007, a second spool 1006*b* for cable 1008, a gear 5001 and a spacer 7000. FIGS. 6A-6C respectively show side, end and cross-sectional views of an exemplary embodiment of first spool 1006*a* that corresponds to the dual cable spool shown in FIG. 5 according to the subject matter disclosed herein. FIGS. 7A and 7B respectively show a front view and a cross-sectional view of an exemplary embodiment of a spacer 7000 that corresponds to the dual cable spool shown in FIG. 5 according to the subject matter disclosed herein.

As shown in FIGS. 6A-6C, first spool 1006*a* comprises two flanges 6001 and 6002 and a hub 6003. FIG. 6C is a cross-sectional view of first spool 1006*a* taken along line C-C in FIG. 6A. The size of the projection of flanges 6001 and 6002 from hub 6003 is selected so that a sufficient length of cable 1007 can be wound onto hub 6003 so that multi-stage mast 1002 can be extended to its fully telescoped position and so that cable 1007 is securely positioned within flanges 6001 and 6002. Gear 5001, of which only a portion is shown in FIGS. 6A and 6C, is mounted to flange 6001 in a well-known manner, such as by, but not limited to, using flathead screws and nuts and apertures 6004 (FIG. 6C). Gear 5001 engages in a well-known with a gear 5002 (FIG. 5) coupled to crank arm 1009 (FIG. 1A) and is driven in a well-known manner by gear 5002 for raising and lowering multi-stage masts 1002 and 1003. A sleeve bearing 6005 (FIGS. 6B and 6C) is positioned within an aperture 6006 in first spool 1006*a* in a well-known manner to minimize friction with an axle 5003 (FIG. 5) that is coupled to crank arm 1009 (FIG. 1A). The axle passes through first spool 1006*a*, spacer 7000 and second spool 1006*b*. Apertures 6007 are formed in flanges 6001 and 6002 and receive bolts 5004 (only one shown in FIG. 5) for assembling dual cable spool 1006. It should be understood that the materials and the respective dimensions and thickness of the components forming dual cable spool 1006 are selected based on the stresses that are expected to be experienced by dual cable spool 1006. In one exemplary embodiment, the components forming dual cable spool 1006 comprise, for example, steel. Exemplary dimensions for such a dual cable spool formed from steel could be that the diameter of flanges 6001 and 6002 would be about 5.75", the diameter of hub 6003 would be about 2.5", the diameter of the crank arm axle would be about 0.5", and the diameter of apertures 6006 would about 0.375". It should be understood that second spool 1006*b* is similar to first spool 1006*a*.

FIGS. 7A and 7B respectively show front and cross-sectional views of an exemplary embodiment of a spacer 7000 according to the subject matter disclosed herein. The cross-sectional view of FIG. 7B is taken along line B-B in FIG. 7A. Spacer 7000 comprises apertures 7001 and 7002, and a countersunk inset aperture 7003. Apertures 7001 and 7002 correspond to apertures 6007 of first spool 1006*a* (FIGS. 6B and 6C). Apertures 7001 comprise a countersunk inset aperture 7003 for receiving the head of, for example, an Allen-head bolt 5005 (only one shown in FIG. 5). The Allen-head bolts 5005 are tightened so that spacer 7000 is fastened to first spool 1006*a*. Apertures 7002 do not comprise a countersunk inset, and each aperture 7002 receives a bolt 5004 (only one shown in FIG. 5) that passes through first spool 1006*a*, spacer 7000 and into second spool 1006*b*. The arrangement of apertures 6007 in spools 1006*a* and 1006*b* and apertures 7001 and 7002 in spacer 7000 allow the respective lengths of cables 1007 and 1008 to be effectively coarsely adjusted with respect to each other by rotating spool 1006*a* (1006*b*) with respect to the other spool 1006*b* (1006*a*) so that any slack or coarse difference between the effective lengths of cables 1007 and 1008 as each cable spans its respective cable path can be taken up onto the spool. After the coarse difference between the effect cable paths has been removed, the bolts are then inserted into apertures 6007, 7001 and 7002 and tightened. That is, any coarse difference in length of the respective cables can be effectively removed so that multi-stage masts 1002 and 1003 can be raised and lowered in a simultaneous manner substantially equally and so fly bar 1004 remains substantially level as multi-stage masts 1002 and 1003 are raised and lowered simultaneously in unison. In one exemplary embodiment, fine adjustments to the differences in the effective lengths of cables 1007 and 1008 are compensated for by fine-adjustment mechanism 4000. It should be understood that the materials and the respective dimensions and thickness of spacer 7000 are selected based on the expected stresses that will be experienced by spacer 7000. For example, in one exemplary embodiment, spacer 7000 could comprise steel or aluminum. Exemplary dimensions for such a steel spacer could be such that the diameter of spacer 7000 is about 3.0", the thickness is about 1.0", and the diameter of apertures 7001 and 7002 would about 0.375".

Figure 6D:
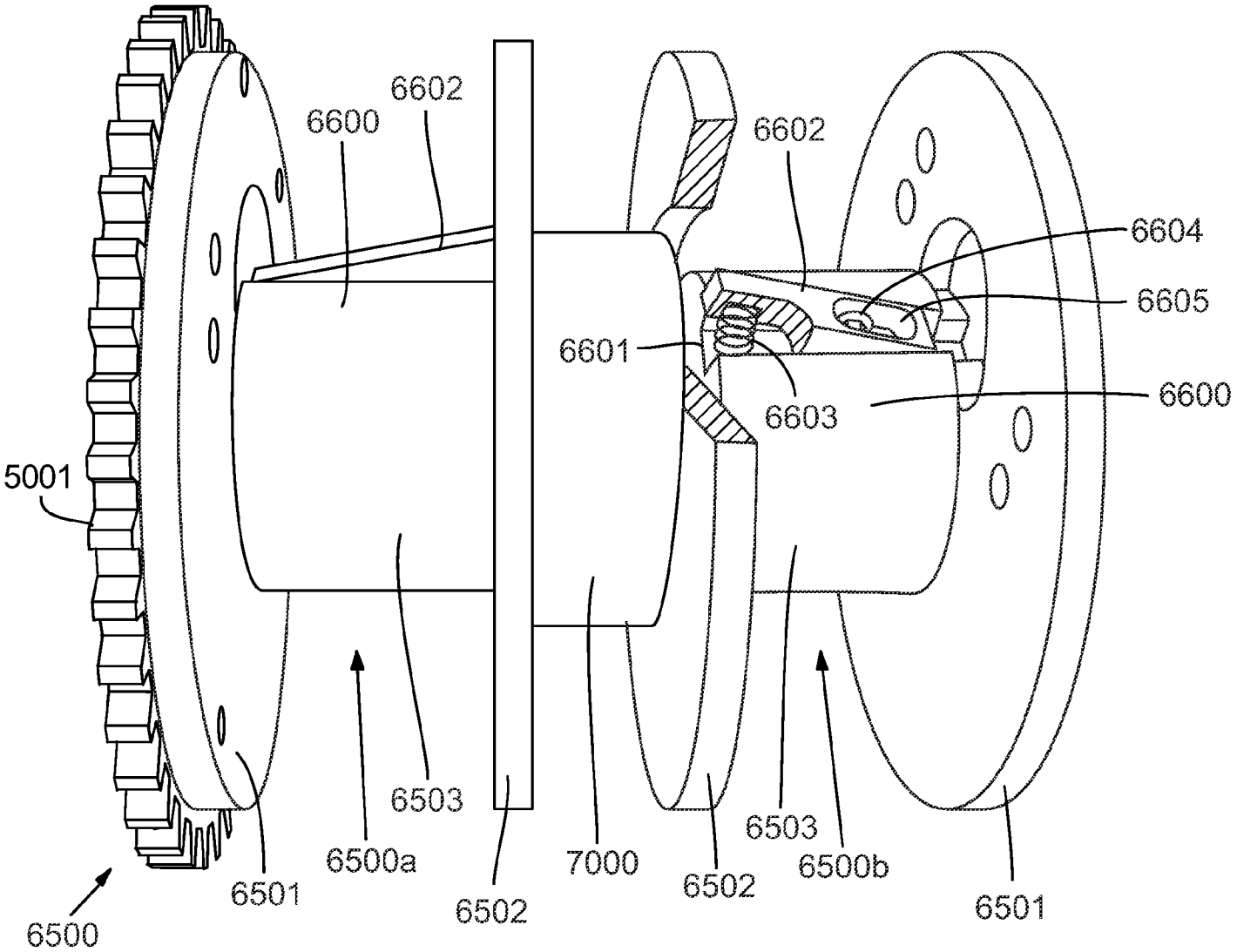
FIG. 6D depicts an exemplary embodiment of a cable-adjustor spool that is suitable for use as dual cable spool according to the subject matter disclosed herein.

FIG. 6D depicts an exemplary embodiment of a cable-adjustor spool 6500 that is suitable for use as dual cable spool 1006 according to the subject matter disclosed herein. Cable-adjustor spool 6500 comprises a first spool 6500*a* for cable 1007, a second spool 6500*b* for cable 1008, a gear 5001 and a spacer 7000. First spool 6500*a* comprises two flanges 6501 and 6502 and a hub 6503. The size of the projection of flanges 6501 and 6502 from hub 6503 is selected so that cable 1007 can be wound onto hub 6503 and multi-stage mast 1002 can be extended to its fully telescoped position and so that cable 1007 is securely positioned within flanges 6501 and 6502. Similarly, second spool 6500*b* comprises two flanges 6501 and 6502 and a hub 6503. The size of the projection of flanges 6501 and 6502 from hubs 6503 is selected so that cable 1007 (and cable 1008) can be wound onto hub 6503 and multi-stage mast 1002 (and multi-stage mast 1003) can be extended to its fully telescoped position and so that cables 1007 and 1008 are securely positioned within flanges 6501 and 6502. Specific dimensions for flanges 6501 and 6502 and hub 6503 may be selected to be similar to those described elsewhere for flanges 6001 and 6002 and hub 6003. Additionally, it should be understood that FIG. 6D shows components and features that are similar to the components and features of dual cable spool 1006 described in connection with FIGS. 5, 6A-6C, 7A and 7B, but are not described in connection with cable-adjustor spool 6500 and do not have reference indicators in FIG. 6D.

Hub 6503 comprises a hub body 6600, a keyway 6601, a cable director 6602, a spring member 6603, and a holding member 6604. Keyway 6601 is formed in the surface on hub body 6600 on which a cable is wound. Cable director 6602 fits into keyway 6601 in a well-known manner. For example, one end of cable director 6602 comprises an aperture 6605 that receives a holding member 6604, such as an Allen-head bolt. Spring member 6603 is received in an aperture 6606 formed in keyway 6601 and biases, or urges, cable director 6602 away from keyway 6601 in a well-known manner.

The configuration of hub 6503 assists cables 1007 and 1008 to wind and unwind from cable-adjustor spool 6500 at the same relative rate. In particular, for the exemplary embodiment of the dual cable spool 1006 shown in FIG. 5, if cables 1007 and 1008 were constantly under tension, then the first few wraps of the cables onto the spool would be uniform and consistently located on the spool. Over time, the cables would form a memory and winding and unwinding the cables from the spool would continue to be uniform and consistently located. In actuality, when the multi-stage masts are completely retracted (i.e., not telescoped) and when the load gets to the bottom, the tension on cables 1007 and 1008 relaxes so that there is no tension on cables 1007 and 1008. Over time, cables 1007 and 1008 will exhibit a coil-spring effect such that the first and second wraps of the cables will have a tendency to stay together on the spool, but the third and subsequent wraps will have a tendency to separate from the first two wraps when tension is removed from the cables. Upon reapplying a load to the cables, each cable will "grab" the spool at whatever point it is located, thereby resulting in the possibility that there will be gaps in the spool windings leading to uneven cable wrapping and the possibility that the cables may wind and unwind at significantly different rates. Under certain conditions, the multi-stage masts might telescope at significantly different rates that cannot be adjusted for by fine-adjustment mechanism 4000. In operation, cable director 6602 of cable-adjustor spool 6500 directs at least the first two windings of a cable toward flange 6501 to form directly adjacent windings. As more cable is wound onto the spool, the compressive forces of the cable winding exceeds the force exerted by spring member 6603 on cable director 6602 and cable director 6602 is pressed into keyway 6601. As more windings are wrapped onto the spool, the spool operates in a normal manner.

Figure 8A:
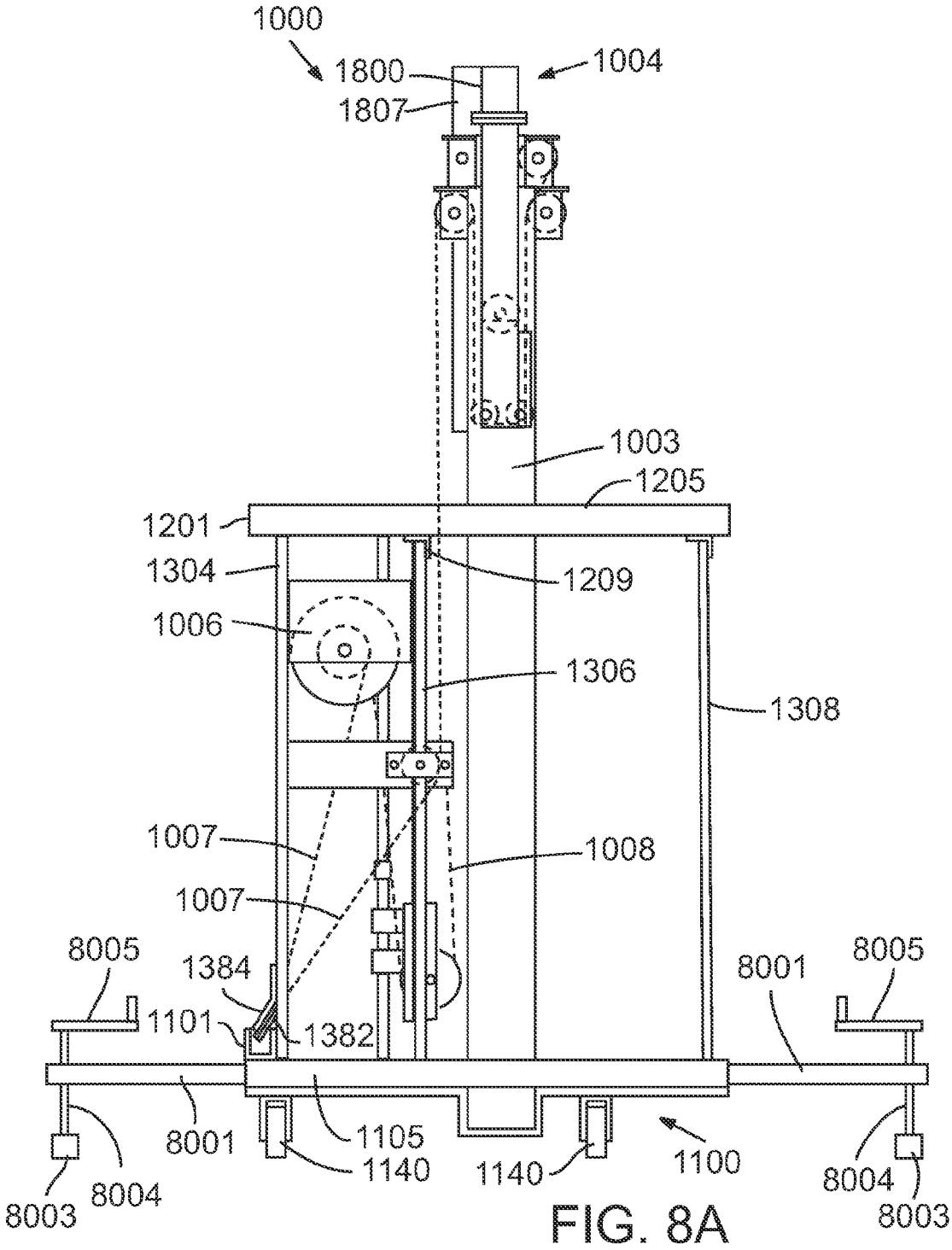
FIGS. 8A and 8B respectively show side and top views of an exemplary embodiment of lift device comprising an exemplary embodiment of outrigger-type legs to increase the overall stability of the lift device according to the subject matter disclosed herein.
Figure 8B:
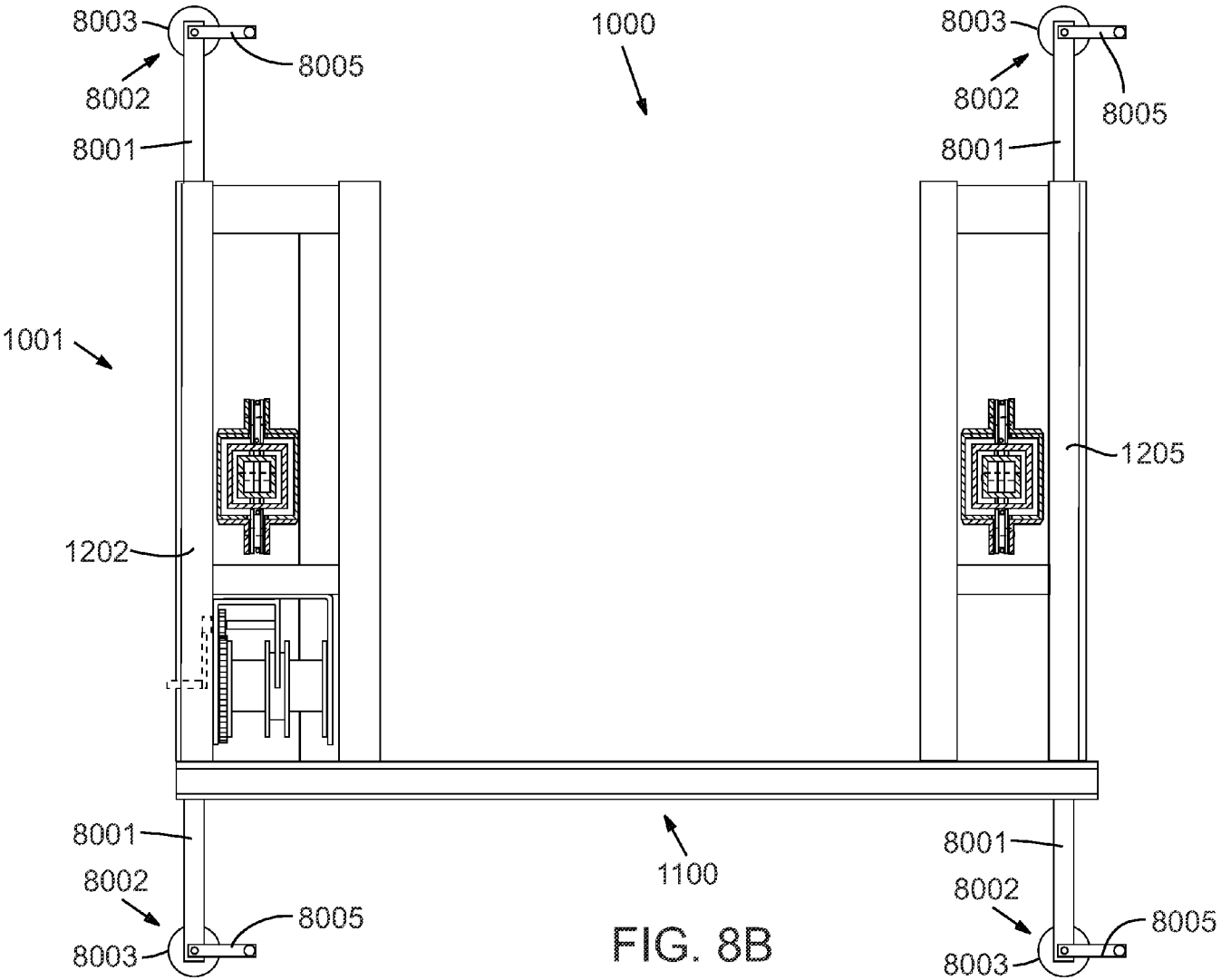

FIGS. 8A and 8B respectively show side and top views of an exemplary embodiment of lift device 1000 comprising an exemplary embodiment of outrigger-type legs 8001 to increase the overall stability of the lift device according to the subject matter disclosed herein. For one exemplary embodiment, outrigger-type legs 8001 comprise a height adjustment mechanism 8002. In one exemplary embodiment, height adjustment mechanism 8002 comprises a base piece 8003, an adjustment shaft 8004 and a crank arm 8005. In one exemplary embodiment, outrigger-type legs 8001 are configured to couple in a well-known manner to frame members 1102 (not shown in FIG. 8A) and 1105 (shown in FIG. 8A) and extend outwardly from base frame portion 1100. While FIGS. 1A, 2A and 2D depict base frame members 1103 and 1104 as being tubular members capable of coupling in a well-known manner to outrigger-type legs 8001, it should be understood that an exemplary alternative embodiment comprises only base frame members 1102 and 1105 that are capable of coupling in a well-known manner to outrigger-type legs 8001.

Although the foregoing disclosed subject matter has been described in some detail for purposes of clarity of understanding, it will be apparent that certain changes and modifications may be practiced that are within the scope of the appended claims. Accordingly, the present embodiments are to be considered as illustrative and not restrictive, and the subject matter disclosed herein is not to be limited to the details given herein, but may be modified within the scope and equivalents of the appended claims.

What is claimed is:

1. A lifting device, comprising:

a frame comprising two ends that are opposite from each other along a first axis of the frame, at least two multi-stage masts, each multi-stage mast corresponding to another multi-stage mast to form a pair of multi-stage masts, each multi-stage mast of a pair of multi-stage masts being attached to a respectively opposite end of the frame in an upright configuration with respect to the frame and substantially axially aligned with the other multi-stage mast of the pair of multi-stage masts, the axial alignment of the pair of multi-stage masts being substantially parallel to the first axis of the frame, each multi-stage mast comprising a first length configuration and a second length configuration, the second length configuration being longer than the first length configuration, each multi-stage mast further comprising a plurality of stages, at least one stage of a mast being vertically movable with respect to at least one other stage of the mast; and a cable mechanism coupled to each multi-stage mast, the cable mechanism comprising:

a spool; and at least one cable coupled to the spool and arranged with respect to the multi-stage masts so that when each cable is wound onto the spool, each mast simultaneously and in unison changing length in a direction from the first length configuration to the second length configuration, and when each cable is unwound off the spool, each mast changing length simultaneously and in unison in a direction from the second length configuration to the first length configuration.

2. The lifting device according to claim 1, wherein each first multi-stage mast comprises a bottom end and a top end, the lifting device further comprising a support member spanning between the top end of a first multi-stage mast and a second multi-stage mast, the support member being capable of supporting an object, the first and second multi-stage masts forming a pair of multi-stage masts, and wherein at least the first and second multi-stage masts are capable of changing length simultaneously and in unison in a direction from the first length to the second length when an object is supported from the support member when the cable is wound onto the spool, and the first and second multi-stage masts are capable of changing length simultaneously and in unison in a direction from the second length configuration to the first length configuration when an object is supported from the support member when the cable is unwound off the spool.

3. The lifting device according to claim 2, wherein at least one of the first and second multi-stage masts comprise an outer-most stage that substantially surrounds at least one other stage of the multi-stage mast when the multi-stage mast is in the first length configuration, and one of the stages of the multi-stage mast comprises an inner-most stage that is substantially surrounded by each of the stages comprising the multi-stage mast when the multi-stage mast is in the first length configuration, each stage of the multi-stage mast comprising a bottom end and a top end that respectively correspond to the bottom end and the top end of the multi-stage mast, and wherein the cable mechanism comprises a first cable for the first multi-stage mast and the second cable for a second multi-stage mast, at least one of the first cable or the second cable being attached to the top end of the stage that is immediately adjacent to and substantially surrounds the inner-most stage of the multi-stage mast corresponding to the cable.

4. The lifting device according to claim 3, wherein the cable mechanism further comprises an adjusting device capable of changing an effective path length of the first cable with respect to an effective path length of the second cable so that the support member spanning between the top end of the first multi-stage mast and the second multi-stage mast remains substantially in a selected orientation with respect to the horizontal as the first and second multi-stage masts change length simultaneously and in unison between the first length configuration and the second length configuration.

5. The lifting device according to claim 4, further comprising a hoisting mechanism capable of lifting an object that is to be supported by the support member spanning between the top end of the first and second multi-stage masts into proximity of the support member.

6. The lifting device according to claim 5, further comprising a frame supporting the multi-stage masts, the frame comprising a shape that is capable of surrounding at least a portion of three sides of an object that is to be supported by the support member spanning between the top end of the first and second multi-stage masts.

7. The lifting device according to claim 6, wherein the frame comprises a plurality of wheels capable of permitting the lifting device to roll from a first location to a second location.

8. The lifting device according to claim 7, wherein the spool comprises a spool hub comprising a first end and a second end, and first and second flange members respectively disposed at the first end and the second end of the spool hub, and a cable adjustor disposed in at least part of the spool hub, the cable adjustor capable of guiding a cable to form at least two directly adjacent windings around the spool hub as the cable is wound onto the spool hub.

9. The lifting device according to claim 8, wherein the spool hub comprises a keyway, wherein the cable adjustor comprises a cable director and a spring member, the cable director comprising a first end and a second end, the first end of the cable adjustor being disposed substantially within the keyway and the spring member being disposed at the second end and biasing the second end of the cable director away from the spool hub, the second end of the cable adjustor being pressed toward the spool hub into the keyway as the at least two directly adjacent windings of the cable are is wound onto the spool hub, and wherein the cable adjustor further comprises a holding member holding the first end of the cable director within the keyway.

10. The lifting device according to claim 9, wherein the cable that is attached to the top end of the stage of the multi-stage mast that is immediately adjacent to and substantially surrounds the inner-most stage of the multi-stage mast is attached using a cable stop.

11. The lifting device according to claim 1, wherein the cable mechanism comprises a first cable for a first multi-stage mast and a second cable for a second multi-stage mast, wherein each first multi-stage mast comprises a bottom end and a top end, the lifting device further comprising a support member spanning between the top end of the first multi-stage mast and the second multi-stage mast, the support member being capable of supporting an object, and wherein the cable mechanism further comprises an adjusting device capable of changing an effective path length of the first cable with respect to an effective path length of the second cable so that the support member spanning between the top end of the first multi-stage mast and the second multi-stage mast remains substantially in a selected orientation with respect to the horizontal as the first and second multi-stage masts change length simultaneously and in unison between the first length configuration and the second length configuration.

12. The lifting device according to claim 11, further comprising a frame supporting the multi-stage masts, the frame comprising a shape that is capable of surrounding at least a portion of three sides of an object that is to be supported by the support member spanning between the top end of the first multi-stage mast and the second multi-stage mast.

13. The lifting device according to claim 12, further comprising a hoisting mechanism capable of lifting the object into proximity of the support member spanning between the top end of the first multi-stage mast and the second multi-stage mast.

14. The lifting device according to claim 13, wherein the spool comprises a spool hub comprising a first end and a second end, and first and second flange members respectively disposed at the first end and the second end of the spool hub, and a cable adjustor disposed in at least part of the spool hub, the cable adjustor capable of guiding a cable to form at least two directly adjacent windings around the spool hub as the cable is wound onto the spool hub.

15. The lifting device according to claim 14, wherein the spool hub comprises a keyway, wherein the cable adjustor comprises a cable director and a spring member, the cable director comprising a first end and a second end, the first end of the cable adjustor being disposed substantially within the keyway and the spring member being disposed at the second end and biasing the second end of the cable director away from the spool hub, the second end of the cable adjustor being pressed toward the spool hub into the keyway as the at least two directly adjacent windings of the cable are is wound onto the spool hub, and wherein the cable adjustor further comprises a holding member holding the first end of the cable director within the keyway.

16. The lifting device according to claim 15, wherein at least one multi-stage mast comprises at least one stage that surrounds another stage when the multi-stage mast is in the first length configuration.

17. The lifting device according to claim 1, wherein each first multi-stage mast comprises a bottom end and a top end, the lifting device further comprising a support member spanning between the top end of a first multi-stage mast and a second multi-stage mast, the support member being capable of supporting an object, and a frame supporting the multi-stage masts, the frame comprising a shape that is capable of surrounding at least a portion of three sides of an object that is to be supported by the support member spanning between the top end of the first and second multi-stage masts.

18. The lifting device according to claim 17, wherein the first and second multi-stage masts are capable of changing length simultaneously and in unison in a direction from the first length configuration to the second length configuration when an object is supported from the support member when the cable is wound onto the spool, and the first and second multi-stage masts are capable of changing length simultaneously and in unison in a direction from the second length to the first length when an object is supported from the support member when the cable is unwound off the spool.

19. The lifting device according to claim 18, wherein the cable mechanism comprises a first cable for the first multi-stage mast and a second cable for the second multi-stage mast.

20. The lifting device according to claim 19, wherein the cable mechanism further comprises an adjusting device capable of changing an effective path length of the first cable with respect to an effective path length of the second cable so that the support member spanning between the top end of the first multi-stage mast and the second multi-stage mast remains substantially in a selected orientation with respect to the horizontal as the first and second multi-stage masts change length simultaneously and in unison between the first length and the second length.

21. The lifting device according to claim 20, further comprising a hoisting mechanism capable of lifting an object that is to be supported by the support member spanning between the top end of the first and second multi-stage masts into proximity of the support member.

22. The lifting device according to claim 21, wherein the frame comprises a plurality of wheels capable of permitting the lifting device to roll from a first location to a second location.

23. The lifting device according to claim 22, wherein the spool comprises a spool hub comprising a first end and a second end, and first and second flange members respectively disposed at the first end and the second end of the spool hub, and a cable adjustor disposed in at least part of the spool hub, the cable adjustor capable of guiding a cable to form at least two directly adjacent windings around the spool hub as the cable is wound onto the spool hub.

24. The lifting device according to claim 23, wherein the spool hub comprises a keyway, wherein the cable adjustor comprises a cable director and a spring member, the cable director comprising a first end and a second end, the first end of the cable adjustor being disposed substantially within the keyway and the spring member being disposed at the second end and biasing the second end of the cable director away from the spool hub, the second end of the cable adjustor being pressed toward the spool hub into the keyway as the at least two directly adjacent windings of the cable are is wound onto the spool hub, and wherein the cable adjustor further comprises a holding member holding the first end of the cable director within the keyway.

25. The lifting device according to claim 24, wherein at least one multi-stage mast comprises at least one stage that surrounds another stage when the multi-stage mast is in the first length configuration.

26. A device, comprising:

a spool comprising a spool hub comprising a first end and a second end, and first and second flange members respectively disposed at the first end and the second end of the spool hub, the spool hub comprising a keyway; and a cable adjustor disposed in at least part of the spool hub, the cable adjustor capable of guiding a cable to form at least two directly adjacent windings around the spool hub as the cable is wound onto the spool hub, the cable adjustor comprising a cable director and a spring member, the cable director comprising a first end and a second end, the first end of the cable adjustor being disposed substantially within the keyway and the spring member being disposed at the second end and biasing the second end of the cable director away from the spool hub, the second end of the cable adjustor being pressed toward the spool hub into the keyway as the at least two directly adjacent windings of the cable are is wound onto the spool hub.

27. The device according to claim 26, wherein the cable adjustor further comprises a holding member holding the first end of the cable director within the keyway.

28. The device according to claim 27, further comprising:

at least two multi-stage masts, each multi-stage mast comprising a first length configuration and a second length configuration, the second length configuration being longer than the first length configuration, each multi-stage mast further comprising a plurality of stages, at least one stage of a mast being vertically movable with respect to at least one other stage of the mast; and a cable mechanism coupled to each multi-stage mast, the cable mechanism comprising:

the spool; and at least one cable coupled to the spool and arranged with respect to the multi-stage masts so that when each cable is wound onto the spool, each mast simultaneously and in unison changing length in a direction from the first length configuration to the second length configuration, and when each cable is unwound off the spool, each mast changing length simultaneously and in unison in a direction from the second length configuration to the first length configuration.

29. The device according to claim 28, further comprising at least one additional spool comprising a spool hub comprising a first end and a second end, and first and second flange members respectively disposed at the first end and the second end of the spool hub, and a cable adjustor disposed in at least part of the spool hub, the cable adjustor capable of guiding a cable to form at least two directly adjacent windings around the spool hub as the cable is wound onto the spool hub.

30. The device according to claim 29, wherein the spool hub of the additional spool comprises a keyway, and wherein the cable adjustor of the additional spool comprises a cable director and a spring member, the cable director comprising a first end and a second end, the first end of the cable adjustor being disposed substantially within the keyway and the spring member being disposed at the second end and biasing the second end of the cable director away from the spool hub, the second end of the cable adjustor being pressed toward the spool hub into the keyway as the at least two directly adjacent windings of the cable are is wound onto the spool hub.

31. The device according to claim 30, wherein the cable adjustor of the additional spool further comprises a holding member holding the first end of the cable director within the keyway.

* * * * *

UNITED STATES PATENT AND TRADEMARK OFFICE

CERTIFICATE OF CORRECTION

PATENT NO. : 7,874,544 B2
APPLICATION NO. : 12/043032
DATED : January 25, 2011
INVENTOR(S) : Dana Monroe It is certified that error appears in the above-identified patent and that said Letters Patent is hereby corrected as shown below:

In column 13, line 34, in claim 2, delete “first”.

Signed and Sealed this
Fifteenth Day of March, 2011

David J. Kappos

David J. Kappos
*Director of the United States Patent and Trademark Office*